US006435263B2

(12) United States Patent
Nakamura et al.

(10) Patent No.: US 6,435,263 B2
(45) **Date of Patent: *Aug. 20, 2002**

(54) AGITATED CONTINUOUS CASTING PROCESS FOR ALUMINUM ALLOY

(75) Inventors: Takeyoshi Nakamura; Nobuhiro Saito; Teruyuki Ohtani; Takashi Idegomori; Kiyonobu Mizoue, all of Wako (JP)

(73) Assignee: Honda Giken Kogyo Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/276,691

(22) Filed: Mar. 26, 1999

(30) Foreign Application Priority Data

| | | |
|---|---|---|
| Mar. 31, 1998 | (JP) | 10-103893 |
| Jun. 12, 1998 | (JP) | 10-165601 |
| Jul. 1, 1998 | (JP) | 10-201217 |

(51) Int. Cl.[7] ..... B22D 11/00; B22D 27/02; B22D 19/124

(52) U.S. Cl. ..... 164/468; 164/487; 164/444; 164/504

(58) Field of Search ..... 164/468, 504, 164/487, 444, 466

(56) References Cited

U.S. PATENT DOCUMENTS

| | | | | |
|---|---|---|---|---|
| 4,214,624 A | * | 7/1980 | Foye et al. | 164/89 |
| 5,009,844 A | * | 4/1991 | Laxmanan | 420/548 |

FOREIGN PATENT DOCUMENTS

| | | | |
|---|---|---|---|
| EP | 0 069 270 | | 1/1983 |
| EP | 69270 | * | 1/1983 |
| EP | 0 490 463 | | 6/1992 |
| EP | 0 768 132 | | 4/1997 |
| JP | 8-144003 | * | 6/1996 |

OTHER PUBLICATIONS

The ASM Specialty Handbook®, Aluminum and Aluminum Alloys, Davis, ASM International, first printing, pp. 26–27.*
Patent Abstracts of Japan vol. 096, No. 010, Oct. 31, 1996 & JP 08 144003 A (Mitsubishi Alum Co Ltd), Jun. 4, 1996.

* cited by examiner

*Primary Examiner*—M. Alexandra Elve
*Assistant Examiner*—Kevin McHenry
(74) *Attorney, Agent, or Firm*—Arent Fox Kintner Plotkin & Kahn

(57) ABSTRACT

When a continuous casting is carried out while applying an electromagnetic agitating force to a molten metal of an aluminum alloy composition, the molten metal of the aluminum alloy composition has an Fe content in a range of 0.75% by weight ≦Fe<2% by weight. Thus, a hard Fe-based intermetallic compound can be crystallized as a primary crystallized product, and an acicular intermetallic compound can be pulverized and finely divided by cooperation of the hard Fe-based intermetallic compound with the electromagnetic agitating force.

6 Claims, 29 Drawing Sheets

EXAMPLE 3

EXAMPLE 4

100μm

EXAMPLE 5

100μm

EXAMPLE 3

25μm

EXAMPLE 4

25μm

EXAMPLE 5

25μm

ACICULAR INTERMETALLIC
COMPOUND

EXAMPLE 1

EXAMPLE 1

EXAMPLE 2

EXAMPLE 2

EXAMPLE 7

EXAMPLE 7

EXAMPLE 6b

100μm

AGITATED CONTINUOUS CASTING PROCESS FOR ALUMINUM ALLOY

BACKGROUND OF THE INVENTION

1. Field of the Invention

The present invention relates to an agitated continuous casting process for an aluminum alloy.

2. Description of the Related Art

An aluminum alloy ingot made by an agitated continuous casting process is conventionally used, for example, as a thixocasting material. In a thixocasting process, the casting is carried out by utilizing the fluidity of a semi-molten casting material having solid and liquid phases coexisting therein and hence, it is an essential condition to finely divide a highly-melting crystallized product such as an initial crystal α.

However, when a recycled material is used as a starting material from the resources-saving demand, the following problem is encountered: If the content of Cu, Mn, Ti or the like in the recycled material is large, an acicular intermetallic compound having a high melting point is crystallized in a coalesced manner and cannot be finely divided only by an electromagnetic agitating force.

SUMMARY OF THE INVENTION

Accordingly, it is an object of the present invention to provide an agitated continuous casting process of the above-described type for an aluminum alloy, wherein a hard primary crystallized product is crystallized by specifying the aluminum alloy composition of a molten metal, and not only an initial crystal α but also an acicular intermetallic compound of high melting point can be finely divided by cooperation of the primary crystallized product with an electromagnetic agitating force.

To achieve the above object, according to a first aspect and feature of the present invention, there is provided an agitated continuous casting process for an aluminum alloy, comprising continuously casting a molten metal of an aluminum alloy composition while applying an electromagnetic agitating force to the molten metal, wherein the molten metal of the aluminum alloy composition used has an Fe content in a range of 0.75% by weight $\leqq$Fe<2% by weight.

If the Fe content in the molten metal of the aluminum alloy composition is specified in the above-described range, a hard Fe-based intermetallic compound is crystallized as a primary crystallized product at a temperature equal to or higher than a temperature of crystallization of an initial crystal a, and pulverizes and finely divides the initial crystal a and an acicular intermetallic compound, while being moved at random in a liquid phase by the electromagnetic agitating force.

However, if the Fe content is lower than 0.75% by weight, it is absurd or meaning less to add iron (Fe). On the other hand, if the Fe content is higher than 2% by weight, an Fe-based intermetallic compound is crystallized in an excessive amount, resulting in a remarkably reduced toughness of a produced continuous casting material.

The present inventors have forwarded researches for the agitated continuous casting process and consequently, have made clear that the amount of α-intermetallic compound crystallized in the Fe-based intermetallic compound is increased depending on the Mn content in the molten metal, and the crystallized α-intermetallic compound becomes a massive α-intermetallic compound by its growth, thereby suppressing the crystallization of a fine β-intermetallic compound in the Fe-based intermetallic compound. The massive α-intermetallic compound reduces the cutting property of a produced aluminum alloy member, and moreover, brings about a deterioration in plating property and a reduction in fatigue strength of the aluminum alloy member.

It is another object of the present invention to provide an agitated continuous casting process of the above-described type, wherein the amount of α-intermetallic compound crystallized can be suppressed to an inevitable amount, and the amount of fine β-intermetallic compound crystallized can be increased to an upper limit value.

To achieve the above object, according to a second aspect and feature of the present invention, there is provided an agitated continuous casting process in which a molten metal of an aluminum alloy composition is introduced into a cylindrical water-cooled casting mold disposed immediately below a spout, while being agitated within the spout, wherein the molten metal of the aluminum alloy composition used has an Fe content in a range of 0.75% by weight $\leqq$Fe<2% by weight, and an Mn content which is set at Mn$\leqq$[(Fe/5)+0.2]% by weight, when the Fe content is in a range of 0.75% by weight $\leqq$Fe$\leqq$1.5% by weight; while being Mn$\leqq$[−Fe+2]% by weight, when the Fe content is in a range of 1.5% by weight <Fe<2% by weight; and the molten metal cooling speed CR in an upper peripheral edge of a molten metal agitating area forming portion on an inner peripheral surface of the spout is set in a range of 10° C./sec $\leqq$CR$\leqq$30° C./sec.

If the Fe and Mn contents are set in the above-described ranges, the amount of α-intermetallic compound crystallized can be suppressed to an inevitable amount. The upper peripheral edge is a site where the molten metal cooling speed is slowest. If the molten metal cooling speed CR in the upper peripheral edge is set in the above-described range, the growth of the α-intermetallic compound can be suppressed. This enables the amount of fine β-intermetallic compound crystallized to be increased to an upper limit value to largely enhance the mechanical property of an aluminum alloy member. The cooling speed is calculated from a cooling curve established in the upper peripheral edge. The α-intermetallic compound contributes to the pulverization and fine-dividing of a coalesced acicular intermetallic compound and an initial crystal α.

However, if the Fe and Mn contents depart from the above-described ranges, the amount of α-intermetallic compound crystallized tends to be increased. If the cooling speed CR is lower than 10° C./sec, the growth of the α-intermetallic compound is advanced, whereby the fine β-intermetallic compound is difficult to crystallize, or is not crystallized. On the other hand, if the cooling speed CR is higher than 30° C./sec, the fine-dividing of the initial crystal a in an ingot is insufficient, and the rheologic property of the ingot, because the cooling speed is too high.

Further, the present inventors have forwarded the researches for the agitated continuous casting process and consequently, have investigated that the Fe-based intermetallic compounds are agglomerated in an outer peripheral area of an ingot to form a relatively large agglomerate, depending on the Mn content in the molten metal, and for this reason, it is impossible to provide a sufficient pulverizing and finely-dividing effect by the Fe-based intermetallic compounds in some cases.

The agglomerate is chemically stable and hence, it is difficult to finely divide the agglomerate by an added element. Moreover, the agglomerate has a high melting point and hence, it is difficult to disintegrate and finely divide the agglomerate by a thermal treatment. If a thixocasting is carried out using a casting material including such an agglomerate, the agglomerate is caught in an intact state within a produced aluminum alloy member. Therefore, the toughness, elongation and the like of the aluminum alloy member are remarkably reduced.

It is a further object of the present invention to provide an agitated continuous casting process of the above-described type, wherein the agglomeration of the Fe-based intermetallic compounds in an outer peripheral zone of an ingot made of the aluminum alloy can be suppressed to a large extent, and the segregation of various intermetallic compounds in a center zone of the ingot can be avoided.

To achieve the above object, according to a third aspect and feature of the present invention, there is provided an agitated continuous casting process in which a molten metal of an aluminum alloy composition is introduced into a cylindrical water-cooled casting mold disposed immediately below a spout, while being agitated within the spout, wherein the molten metal of the aluminum alloy composition used has an Fe content in a range of [3/4]% by weight $\leqq$Fe<[5/3]% by weight, and an Mn content in a range of [Fe/5]% by weight $\leqq$Mn <[−Fe+2]% by weight; a magnetic flux density B in a molten metal agitating area forming portion on an inner peripheral surface of the spout is set in a range of 100 Gs$\leqq$B<500 Gs; and a magnetic flux density $B_1$ in a center zone of the molten metal agitating area is set in a range of $B_1 \leqq 20$ Gs.

If the Fe content in the molten metal of the aluminum alloy composition is specified in the above-described range, hard Fe-based intermetallic compounds are crystallized as primary crystallized products at a temperature equal to or higher than a temperature of crystallization of an initial crystal a in the vicinity of the molten metal agitating area forming portion on the inner peripheral surface of the spout. In this case, when the Mn content is in the above-described range, the Fe-based intermetallic compounds are liable to be agglomerated.

Therefore, the magnetic flux density B in the molten metal agitating area forming portion is set in the above-described range to intensify the electromagnetic agitating force applied to the molten metal in the vicinity of such forming portion. Therefore, the dispersion of the Fe-based intermetallic compounds is positively performed, whereby the agglomeration of the Fe-based intermetallic compounds is suppressed to a large extent. Thus, it is possible to provide a sufficient pulverizing and finely-dividing effect by the Fe-based intermetallic compounds. However, if the magnetic flux density B is lower than 100 Gs, the electromagnetic agitating force is so weak that the agglomeration of the Fe-based intermetallic compounds is liable to occur. On the other hand, if the magnetic flux density B is equal to or higher than 500 Gs, the electromagnetic agitating force is so strong that there is a possibility of a phenomenon bringing about that an unsolidified portion in an ingot breaks through a solidified portion in an outer periphery of the ingot, namely, a situation that a break-out is generated to make the casting impossible.

On the other hand, if the magnetic flux density $B_1$ in the center zone of the molten metal agitating area is set in the above-described range, the flowing of the molten metal in the center zone which is a zone where the ingot is finally solidified, can be suppressed to the utmost, thereby avoiding the segregation of various intermetallic compounds. Therefore, $B_1$=0 Gs is included in the magnetic flux density $B_1$. However, if the magnetic flux density $B_1$ is higher than 20 Gs, the flowing of the molten metal in the center zone of the ingot is noticeable, thereby generating the segregation of the intermetallic compounds and the like.

If the Fe content in the molten metal of the aluminum alloy composition is lower than [3/4]% by weight, it is absurd or meaningless to add iron (Fe). On the other hand, if the Fe content is equal to or higher than [5/3]% by weight, the amount of Fe-based intermetallic compounds crystallized is too large and hence, the toughness of an aluminum alloy member made in athixocasting manner is remarkably reduced. If the Mn content is lower than [Fe/5]% by weight, the agglomeration of the Fe-based intermetallic compounds does not occur. On the other hand, if Mn$\geqq$[−Fe+2]% by weight, the toughness of an aluminum alloy member made in a thixocasting manner is remarkably reduced.

The above and other objects, features and advantages of the invention will become apparent from the following description of the preferred embodiment taken in conjunction with the accompanying drawings.

DETAILED DESCRIPTION OF THE PREFERRED EMBODIMENTS

Figure 1:
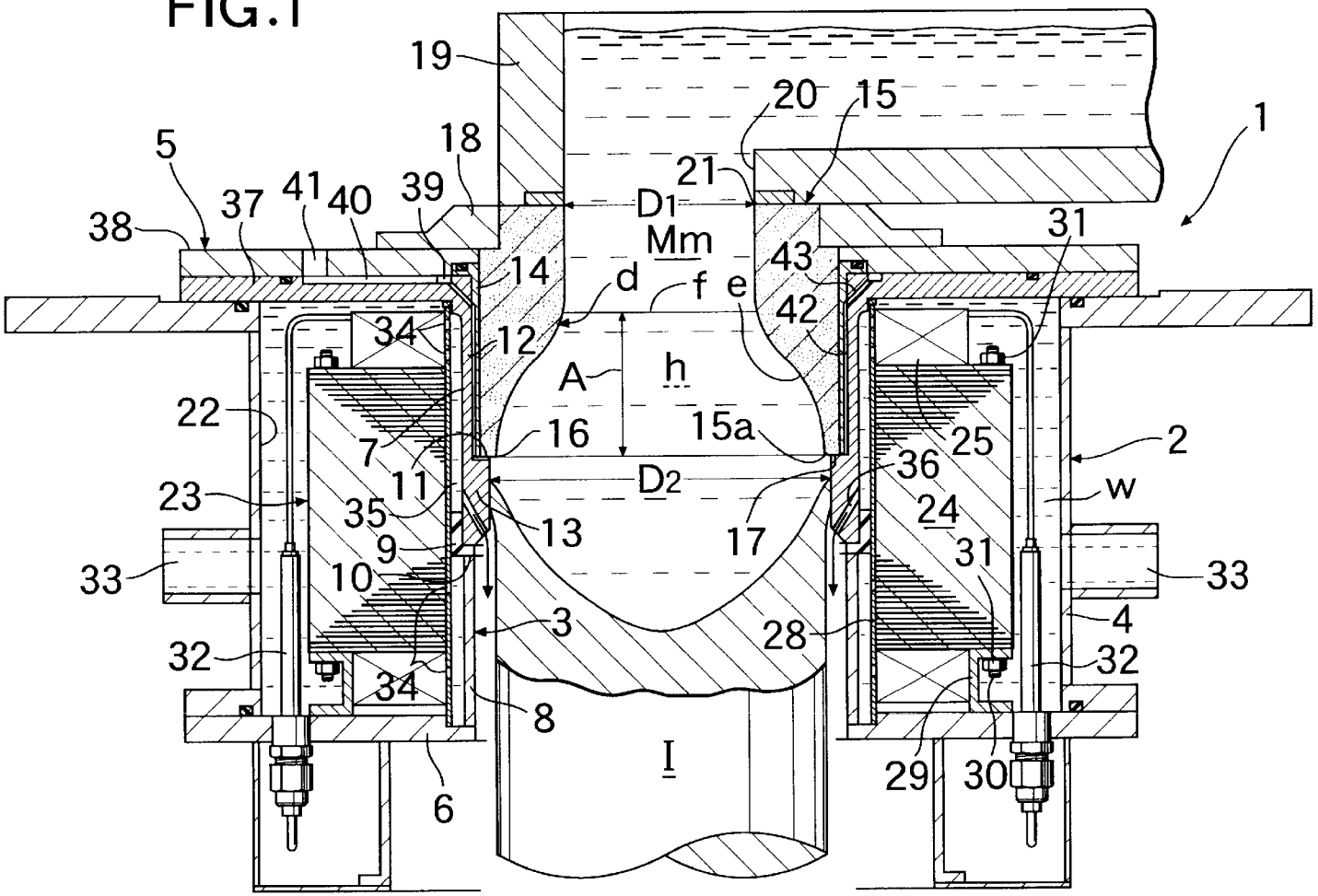
FIG. 1 is a vertical sectional view of a continuous casting apparatus according to a first embodiment of the present invention.
Figure 2:
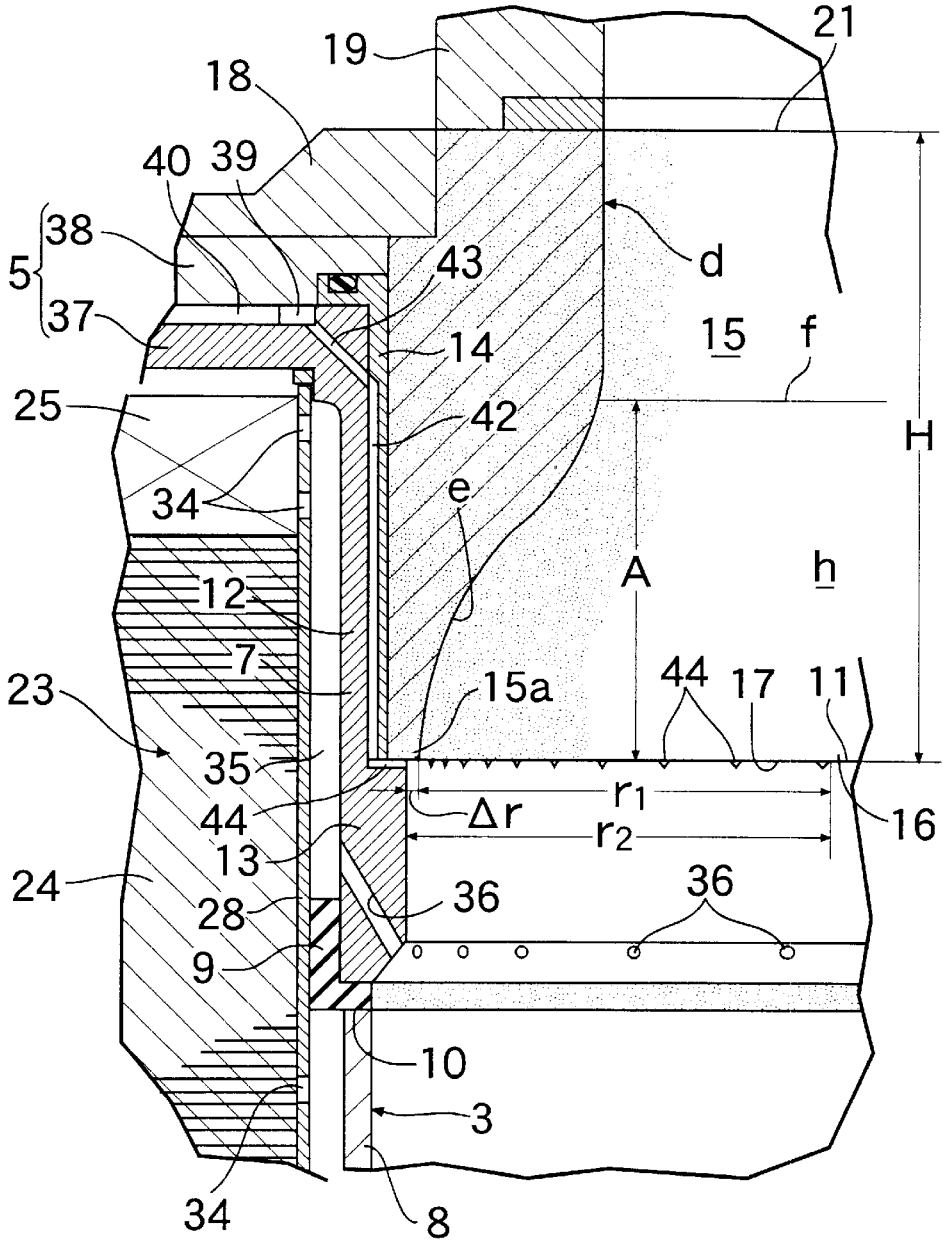
FIG. 2 is an enlarged view of an essential portion shown in FIG. 1.

A continuous casting apparatus 1 shown in FIGS. 1 and 2 includes a drum-shaped body 2 having an axis turned vertically. The drum-shaped body 2 is comprised of an inner peripheral wall 3, an outer peripheral wall 4 disposed at a predetermined distance around the outer periphery of the inner peripheral wall 3, an annular upper end wall 5 located at upper ends of both the walls 3 and 4, and an annular lower end wall 6 located at lower ends of both the walls 3 and 4.

The inner peripheral wall 3 comprises an upper cylindrical member 7 and a lower cylindrical member 8. An inward-turned annular portion 10 of an annular rubber seal 9 fitted over an outer peripheral surface of a lower portion of the upper cylindrical member 7 is sandwiched between the cylindrical members 7 and 8 to seal them from each other. A lower half of the upper cylindrical member 7 is formed with a thickness larger than that of an upper half 12, so that an annular step 11 is formed inside the lower half, thereby forming a cylindrical water-cooled casting mold 13. The water-cooled casting mold 13 is formed of an aluminum alloy (e.g., A5052).

A spout 15 is fitted into the upper half 12 with a thin cylindrical member 14 interposed therebetween, so that it is located coaxially with the water-cooled casting mold 13. An annular lower end surface 17 of the spout 15 forming a downward-turned molten metal outlet 16 abuts against the annular step 11. An annular removal-preventing plate 18 is fitted over that portion of the spout 15 which protrudes from the upper end wall 5, and the removal-preventing plate 18 is fixed to the upper end wall 5. The spout 15 is formed of calcium silicate having a heat-insulating property and a fire resistance. Alternatively, alumina, silica or the like may be used as a material for forming the spout. A molten metal supply tub 19 for pouring a molten metal horizontally is disposed above the spout 15 and has a downward-turned molten metal supply port 20 communicating with an upward-turned molten metal receiving port 21 of the spout 15.

Figure 3:
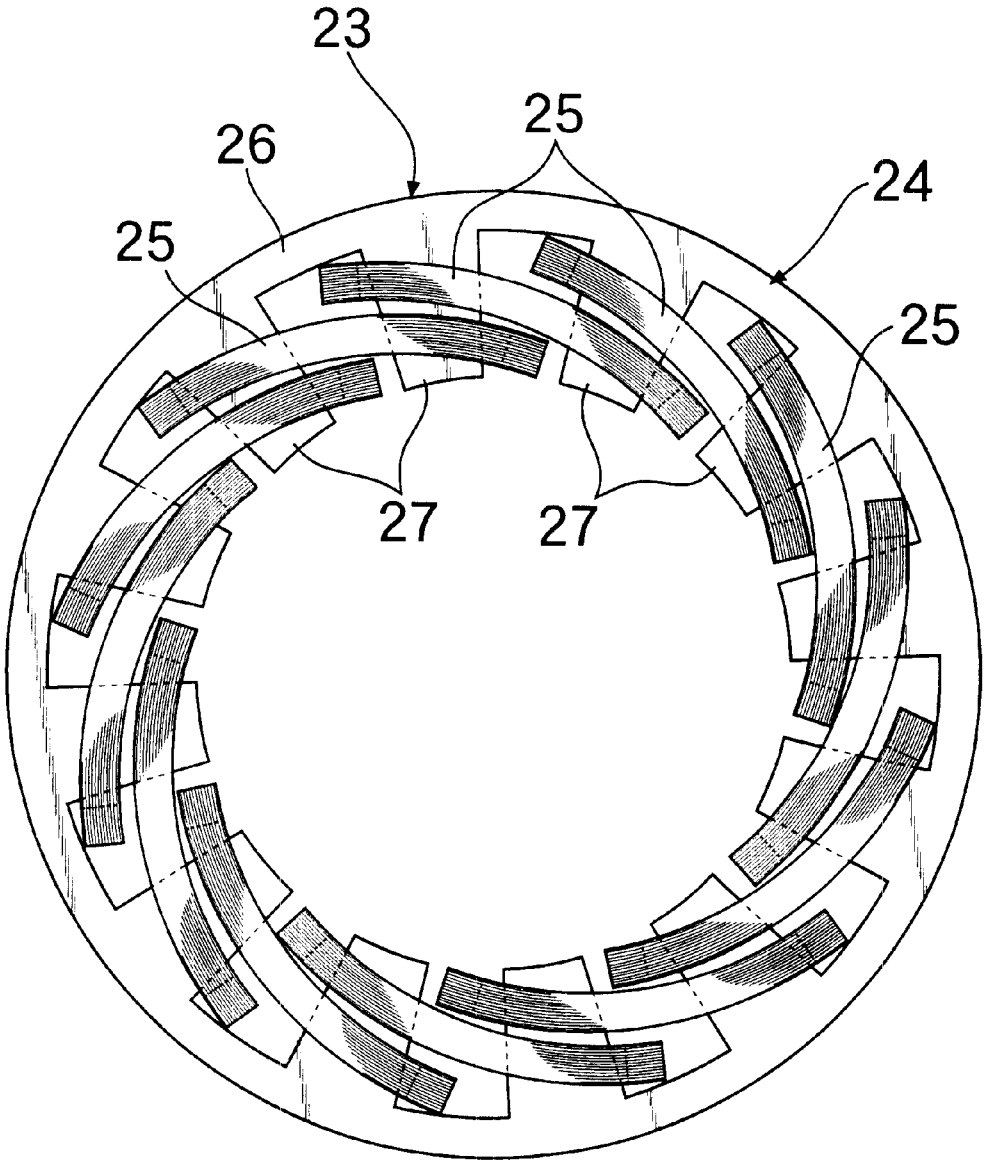
FIG. 3 is a plan view showing the relationship between a stratified iron core and coils.
Figure 4A:
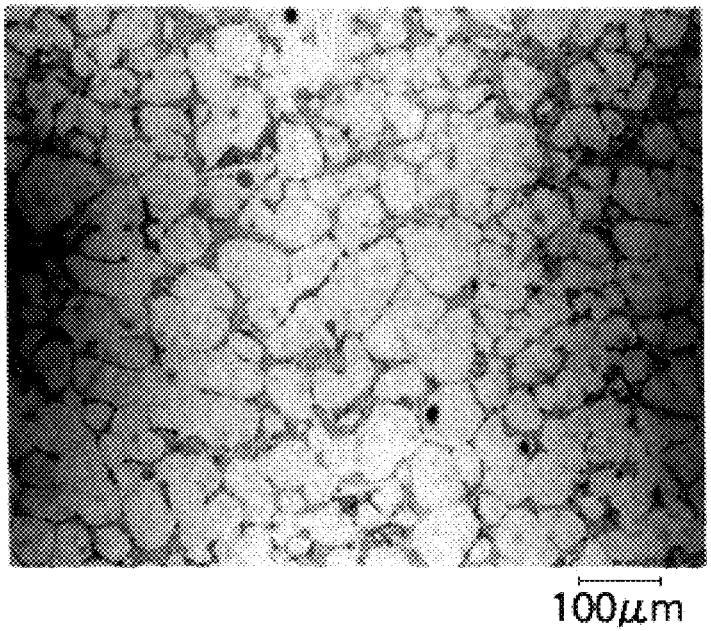
FIG. 4A is a microphotograph showing one example of a metallographic structure of an example 3.
Figure 4B:
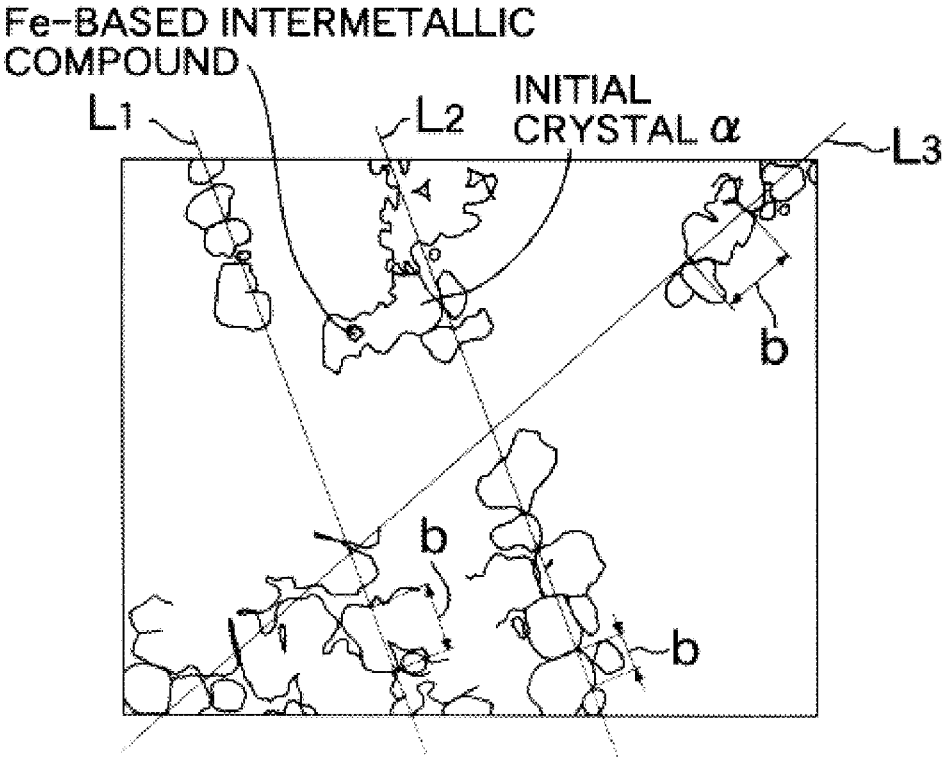
FIG. 4B is a tracing of an essential portion shown in FIG. 4A.
Figure 5A:
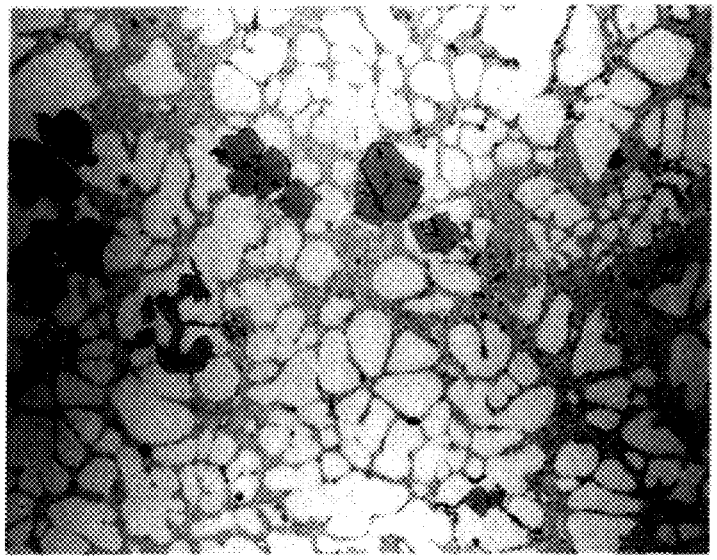
FIG. 5A is a microphotograph showing one example of a metallographic structure of an example 4.
Figure 5B:
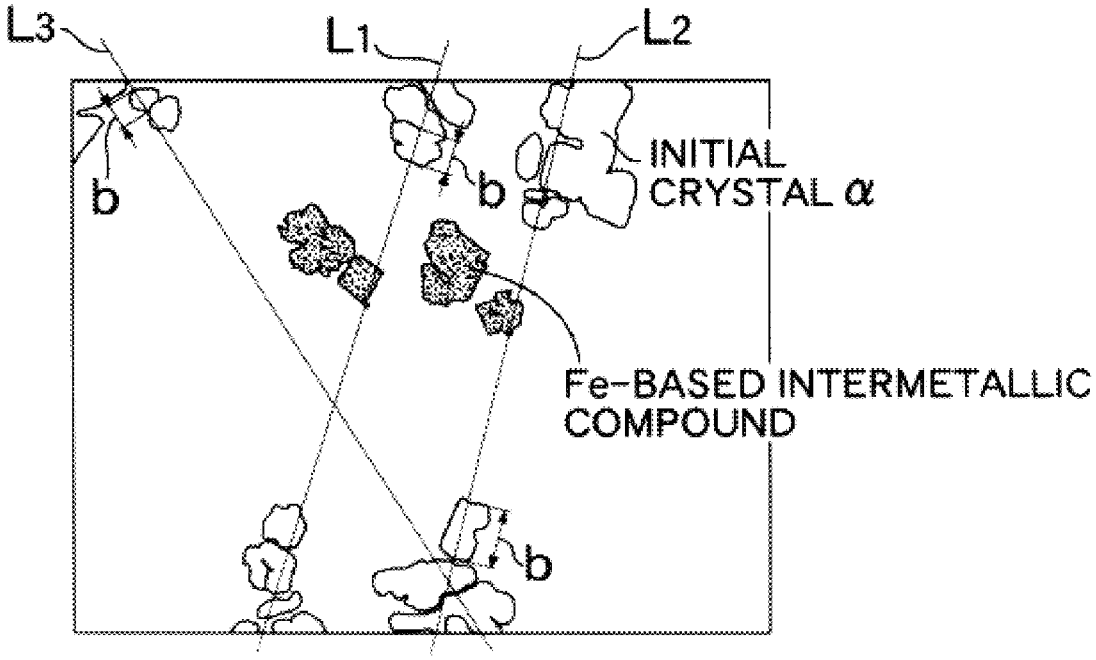
FIG. 5B is a tracing of an essential portion shown in FIG. 5A.
Figure 6A:
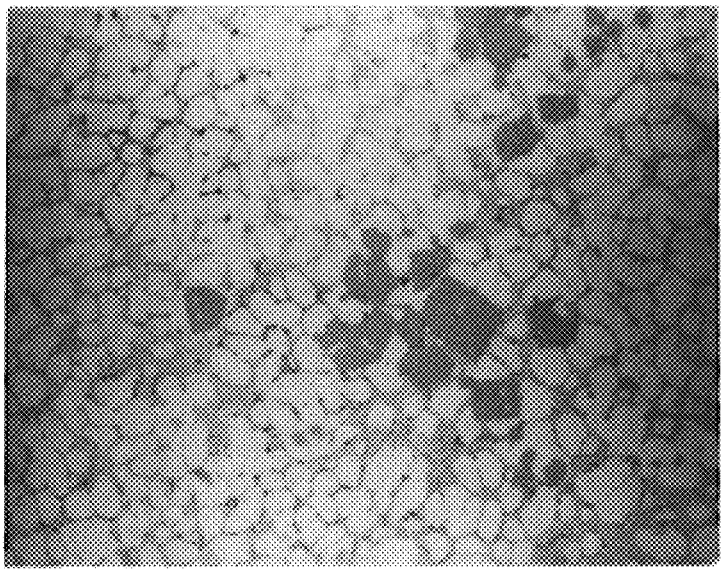
FIG. 6A is a microphotograph showing one example of a metallographic structure of an example 5.
Figure 6B:
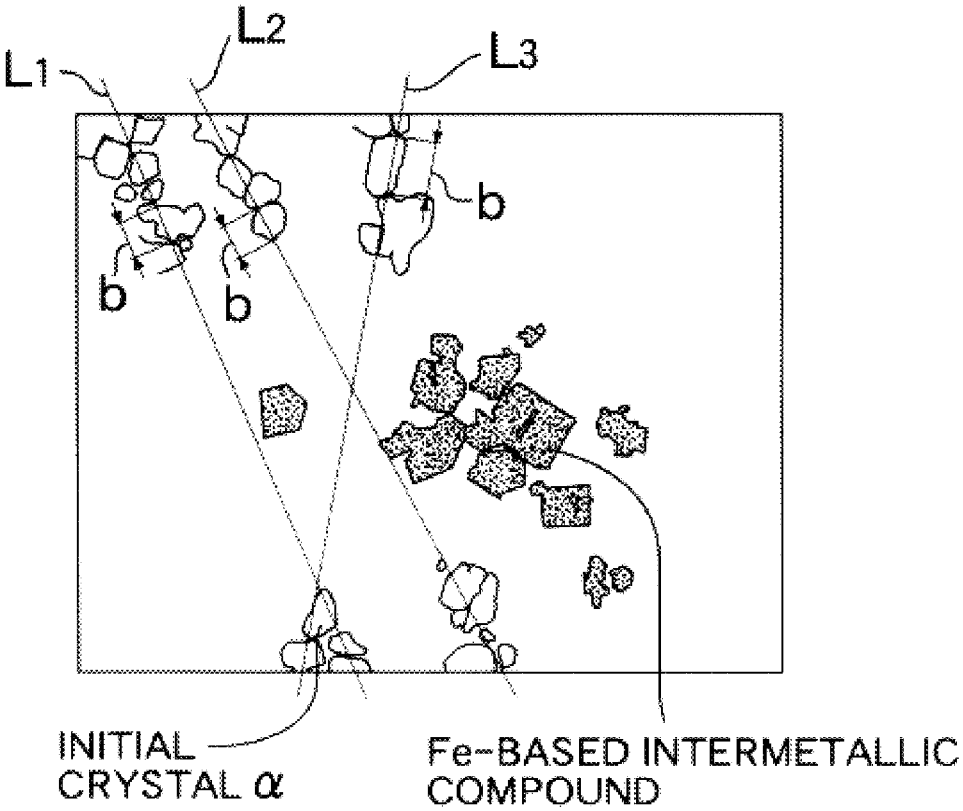
FIG. 6B is a tracing of an essential portion shown in FIG. 6A.
Figure 7A:
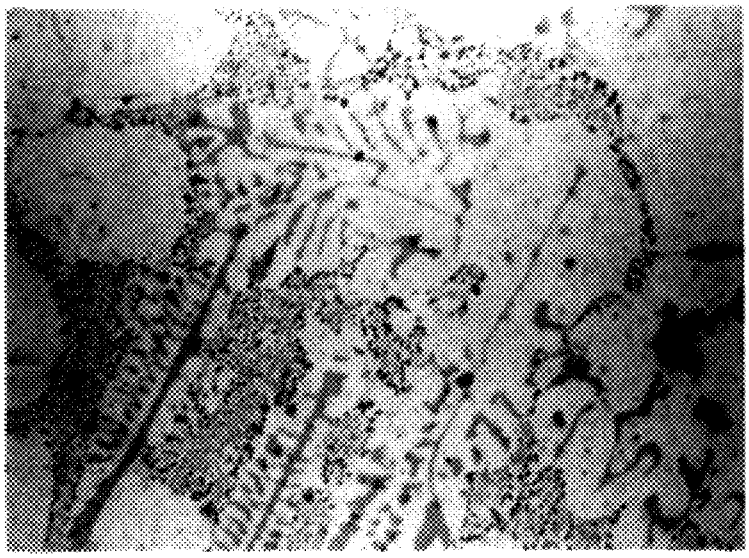
FIG. 7A is a microphotograph showing another example of the metallographic structure of the example 3.
Figure 7B:
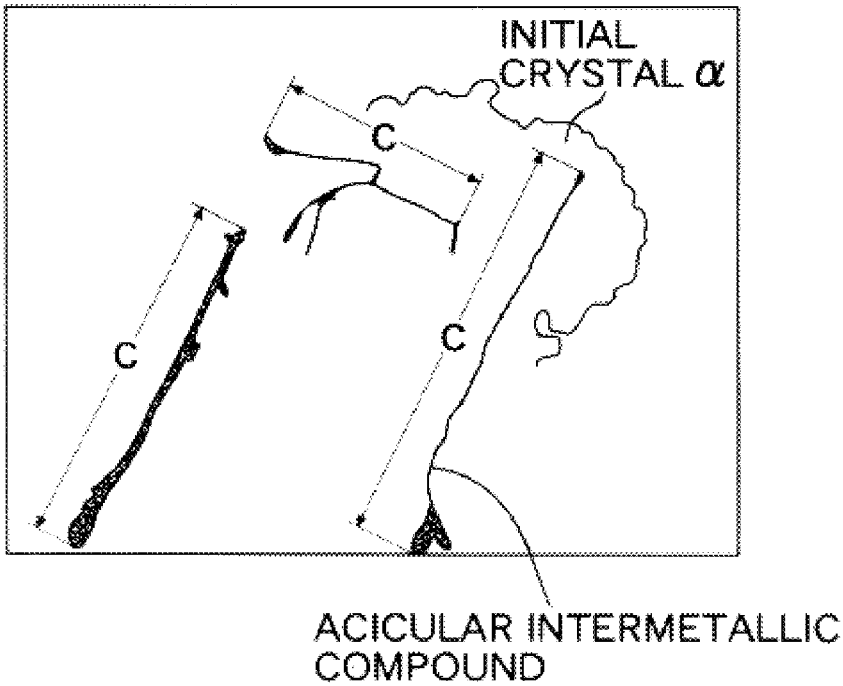
FIG. 7B is a tracing of an essential portion shown in FIG. 7A.
Figure 8A:
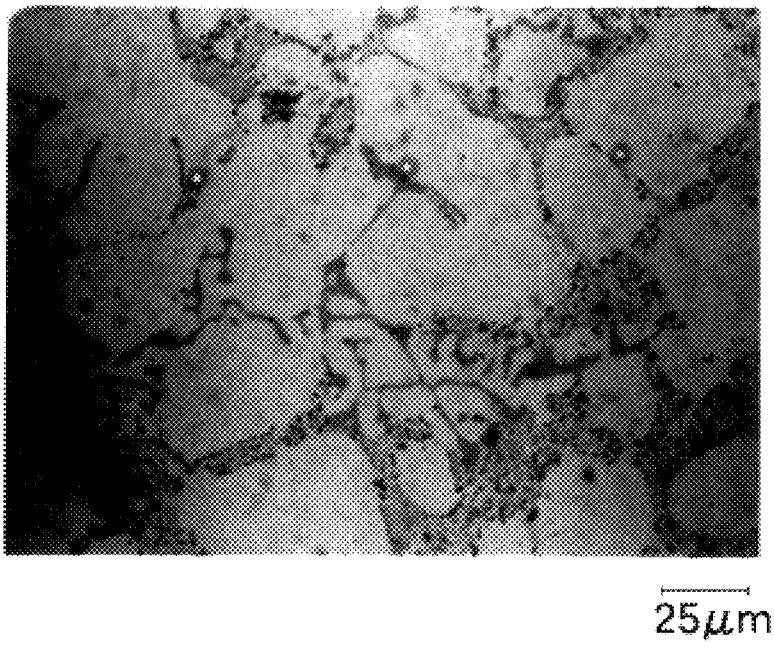
FIG. 8A is a microphotograph showing another example of the metallographic structure of the example 4.
Figure 8B:
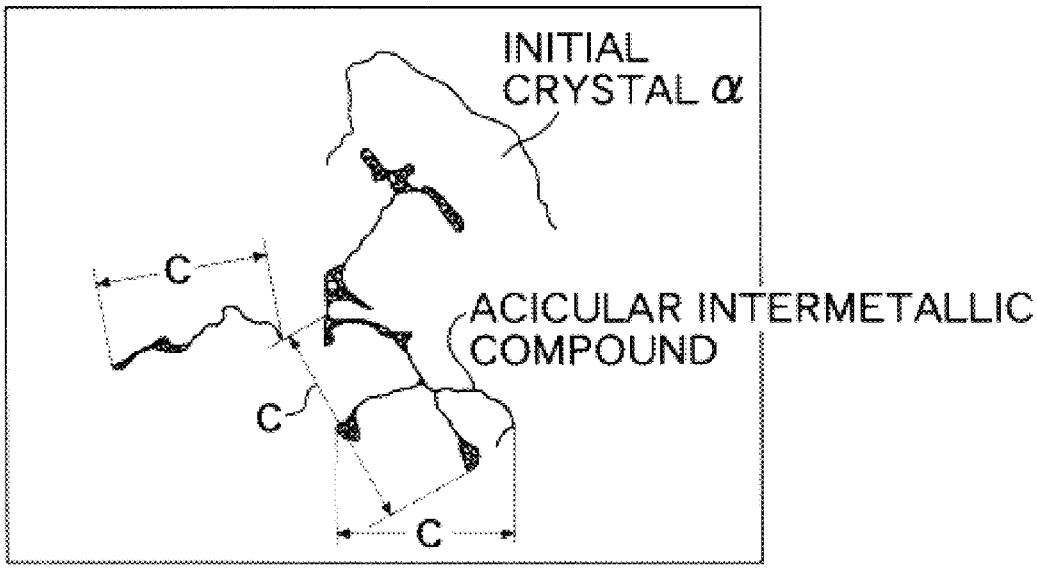
FIG. 8B is a tracing of an essential portion shown in FIG. 8A.
Figure 9A:
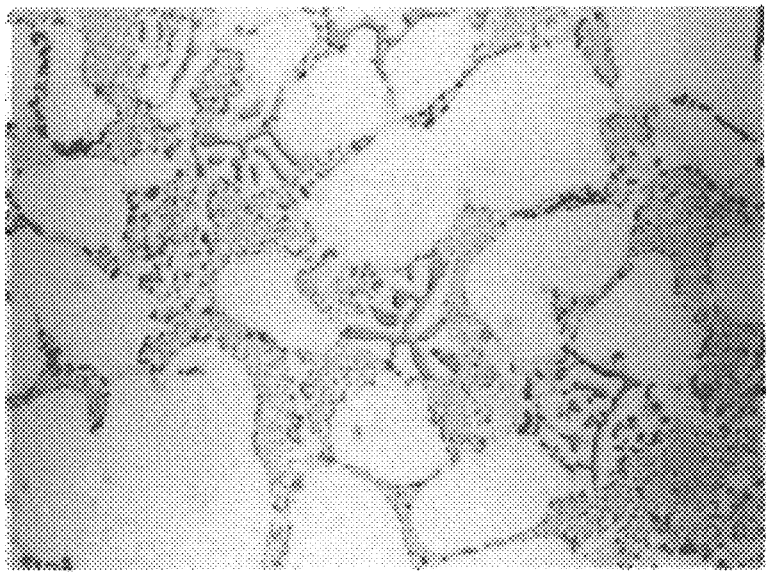
FIG. 9A is a microphotograph showing another example of the metallographic structure of the example 5.
Figure 9B:
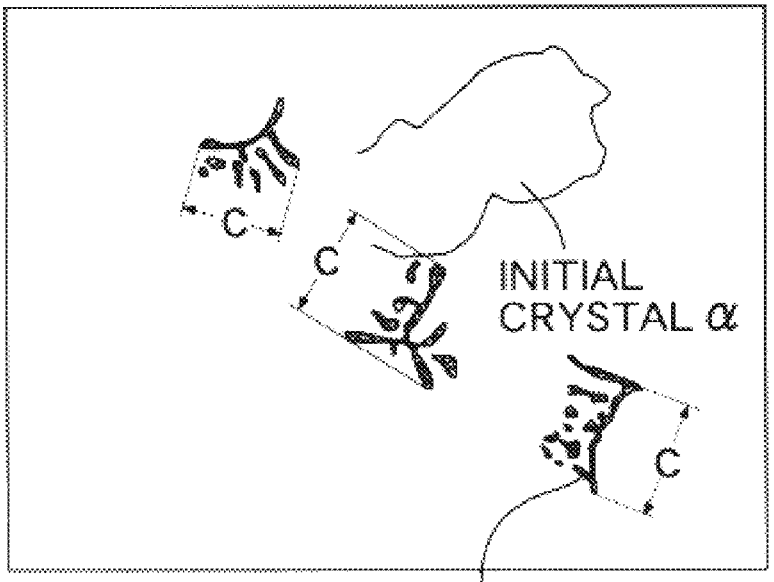
FIG. 9B is a tracing of an essential portion shown in FIG. 9A.

An electromagnetic induction-type agitator 23 is disposed in a cylindrical closed space 22 between the inner and outer peripheral walls 3 and 4 of the drum-shaped body 2, and provides an electromagnetic agitating force to a molten metal Mm present within the spout 15. The agitator 23 comprises a cylindrical stratified iron core 24, and a plurality of coils 25 wound around the cylindrical stratified iron core 24. The stratified iron core 24 is comprised of a cylindrical portion 26, and a plurality of projections 27 disposed circumferentially at equal distances on an inner peripheral surface of the cylindrical portion 26 to extend in a direction of a generating line, as best shown in FIG. 3. Each of the coils 25 is wound around adjacent ones of the projections 27, so that portions of the two coils 25 overlap each other on one projection 27.

A thin cylindrical coil-retaining member 28 is fitted inside the stratified iron core 24, so that a tip end surface of each of the projections 27 is in close contact with the coil-retaining member 28. The cylindrical coil-retaining member 28 is fixed within the cylindrical closed space 22 with a portion of its inner peripheral surface being in close contact with the annular rubber seal 9. The stratified iron core 24 is placed onto an annular support member 29 for the lower end wall 6 and fixed to the annular support member 29 by a plurality of bolts 30 and nuts 31. A plurality of connectors 32 are provided with a ratio of two to one coil 25 and each of the connectors 32 are mounted through the lower end wall 6 by a water-tight means.

A plurality of water supply ports 33 are defined in the outer peripheral wall 4, so that cooling water w is supplied through the water supply ports 33 into the closed space 22. A plurality of through-bores 34 are defined in the cylindrical member 28 inside the stratified iron core 24 and located in the vicinity of an upper end of the cylindrical member 28, whereby a cooling water sump 35 is defined above the annular rubber seal 9. The water-cooled casting mold 13 is cooled by the cooling water sump 35, and has a plurality of ejecting bores 36 for ejecting the cooling water w in the cooling water sump 35 obliquely downwards. The through-bores 34 are also defined in a lower portion of the cylindrical member 28.

In order to supply a lubricating oil to between the water-cooled casting mold 13 and the molten metal Mm, lubricating oil passages which will be described below are provided around the spout 15. In the inner peripheral wall 3, a lower plate 37 of the upper end wall 5 is integrally provided on an upper end of the upper cylindrical member 7. Provided between an upper plate 38 and the lower plate 37 of the upper end wall 5 are an annular passage 39 surrounding the spout 15, and a plurality of straight passages 40 extending radiately from the annular passage 39. An inlet 41 defined in the upper plate 38 communicates with ends of the straight passages 40, and is connected to an oil supply pump. As best shown in FIG. 2, a cylindrical passage 42 is defined between an inner peripheral surface of the upper half 12 of the upper cylindrical member 7 and an outer peripheral surface of the cylindrical member 14, and a plurality of obliquely downward-turned through-bores 43 are defined in a connection between the upper half 12 and the lower plate 37 to permit the communication between the cylindrical passage 42 and the annular passage 39. A lower end of the cylindrical passage 42 communicates with a plurality of V-shaped outlets 44 arranged radiately between the annular step 11 and the annular lower end surface 17 of the spout 15.

A molten metal agitating area A within the spout 15 is a space surrounded by a group of the coils 25 forming a substantially cylindrical shape, and hence, is a region extending from an intermediate portion of the inside of the spout 15 located at the same level as the upper end surface of the group of coils 25 to the molten metal outlet 16. A molten metal agitating area forming portion e of the inner peripheral surface d of the spout is of a tapered shape with its inner diameter gradually increased from its upper peripheral edge f toward the molten metal outlet 16 which is its lower peripheral edge. In the illustrated embodiment, the molten metal agitating area forming portion e forms a curved surface. Further, if an inside radius of the molten metal outlet 16 of the spout 15 is represented by $r_1$, and an inside radius of the water-cooled casting mold 13 is represented by $r_2$, relations $r_1<r_2$ and $r_2-r_1=\Delta r$ (wherein $\Delta r$ is an amount of protrusion of the spout 15) are established between the inside radii $r_1$ and $r_2$. The spout 15 has an annular protrusion 15*a* around the molten metal outlet 16 thereof.

[Embodiment I]

When a molten metal Mm having an aluminum alloy composition is subjected to a continuous casting using the above-described continuous casting apparatus 1, while applying an electromagnetic agitating force to the molten metal Mm, the molten metal Mm having the aluminum alloy composition which may be used, has an Fe content in a range of 0.75% by weight $\leqq$Fe<2% by weight.

Referring to FIG. 1, when the molten metal Mm having the aluminum alloy composition is supplied from the molten metal supply port 20 of the molten metal supply tub 19 into the spout 15, the electromagnetic agitating force is applied to the molten metal Mm within the spout 15 by the agitator 23 and then, the molten metal Mm is cooled by the water-cooled casting mold 13 to produce an ingot I.

If the Fe content in the molten metal Mm having the aluminum alloy composition is specified as described above, a hard Fe-based intermetallic compound is crystallized as a primary crystallized product at a temperature equal to or higher than a temperature of crystallization of an initial crystal $\alpha$. While the intermetallic compound is being moved around at random in a liquid phase by the electromagnetic agitating force, the initial crystal $\alpha$ and an acicular intermetallic compound are pulverized and finely divided. Thus, an ingot I suitable for a thixocasting process, namely, a casting material can be produced.

Particular examples will be described below.

[A] Fe Content

Table 1 shows the composition of an aluminum alloy which is a starting material.

TABLE 1

| Al | Chemical constituent (% by weight) | | | | | | | | | | |
|---|---|---|---|---|---|---|---|---|---|---|---|
| alloy | Cu | Si | Mg | Zn | Fe | Mn | Cr | Ni | Ti | Sr | Balance |
| | 4.8 | 7 | 0.24 | 0.8 | varied | 0.67 | 0.12 | 0.1 | 0.2 | 0.03 | Al |

Molten metals Mm of aluminum alloys having varied Fe contents were prepared, and various ingots I were produced using the continuous casting apparatus 1. Casting conditions are as follows: A casting speed was 150 mm/min; a lubricating oil was a PTFE particle-added mineral oil; the amount of lubricating oil supplied was 1 cc/min; the amount of cooling water supplied was 80 liter/min; the temperature of the molten metal in the molten metal receiving port 21 of the spout 15 was 650° C.; the magnetic flux density B on the inner peripheral surface d of the spout was 360 Gs (4-pole coils, 50 Hz); an average cooling speed MCR of the molten metal Mm contacting the inner peripheral surface d of the spout was 10° C./sec; and a protrusion amount $\Delta r$ of the spout 15 was 2 mm.

(1) An average grain size M of the initial crystal a and an average length m of the acicular intermetallic compound were measured for examples 1 to 8 of the ingots I on the basis of a microphotograph showing the metallographic structures of examples 1 to 8, thereby providing results given in Table 2.

TABLE 2

| Ingot | Fe content X (% by weight) | Average grain size M of initial crystals $\alpha$ ($\mu$m) | Average length m of acicular intermetallic compounds ($\mu$m) |
|---|---|---|---|
| Example 1 | 0.20 | 70 | 110 |
| Example 2 | 0.42 | 65 | 115 |
| Example 3 | 0.51 | 69 | 105 |
| Example 4 | 0.60 | 47 | 54 |
| Example 5 | 0.75 | 39 | 31.3 |
| Example 6 | 0.98 | 39.5 | 33 |
| Example 7 | 1.96 | 40 | 31 |
| Example 8 | 2.20 | 41 | 31 |

FIGS. 4A, 4B, 5A, 5B, 6A and 6B are microphotographs and the tracings of essential portions thereof, showing the metallographic structures of those portions of examples 3 to 5 which include the Fe-based intermetallic compound. In each of FIGS. 4A to 6A, a light gray island-shaped portion is an initial crystal $\alpha$; a dark gray substantially polygonal portion is an Fe-based intermetallic compound; and a stipple-shaped portion filling a space between the adjacent initial crystals a is mainly a eutectic crystal component.

To measure the average grain size M of the initial crystal a, the following method was used: As shown in FIGS. 4B to 6B, three straight lines $L_1$, $L_2$ and $L_3$ crossing a plurality of initial crystals $\alpha$ were drawn, so that two of them intersect the remaining one. In the first straight line $L_1$, a length b of a line segment within each of the initial crystals a was determined, and an average length $Tb/N=M_1$ of the line segments was determined, wherein Tb represents the sum of the lengths b of such line segments, and N represents the total number of the initial crystals a through which the straight line $L_1$ passes. With regard to the second and third straight lines $L_2$ and $L_2$, average lengths $M_2$ and $M_3$ of line segments were likewise determined. Thereafter, an average value $(M_1+M_2+M_3)/3=M$ of the average lengths $M_1$, $M_2$ and $M_3$ was calculated as an average grain size of the initial crystals $\alpha$.

FIGS. 7A, 7B, 8A, 8B, 9A and 9B are microphotographs and the tracings of essential portions thereof, showing the metallographic structures of those portions of examples 3 to 5 which include the acicular intermetallic compound. In each of FIGS. 7A to 9A, a light gray island-shaped portion is an initial crystal α; a dark gray longer portion is an acicular intermetallic compound; and a stipple-like portion filling a space between the adjacent initial crystals a is mainly a eutectic crystal component.

To measure the average length m of the acicular intermetallic compound, lengths c of a plurality of acicular intermetallic compounds were determined, and an average length Tc/n=m of the acicular intermetallic compounds was calculated, as shown in FIGS. 7B to 9B, wherein Tc represents the sum of the lengths c of the acicular intermetallic compounds, and n represents the total number of the acicular intermetallic compounds.

Figure 10:
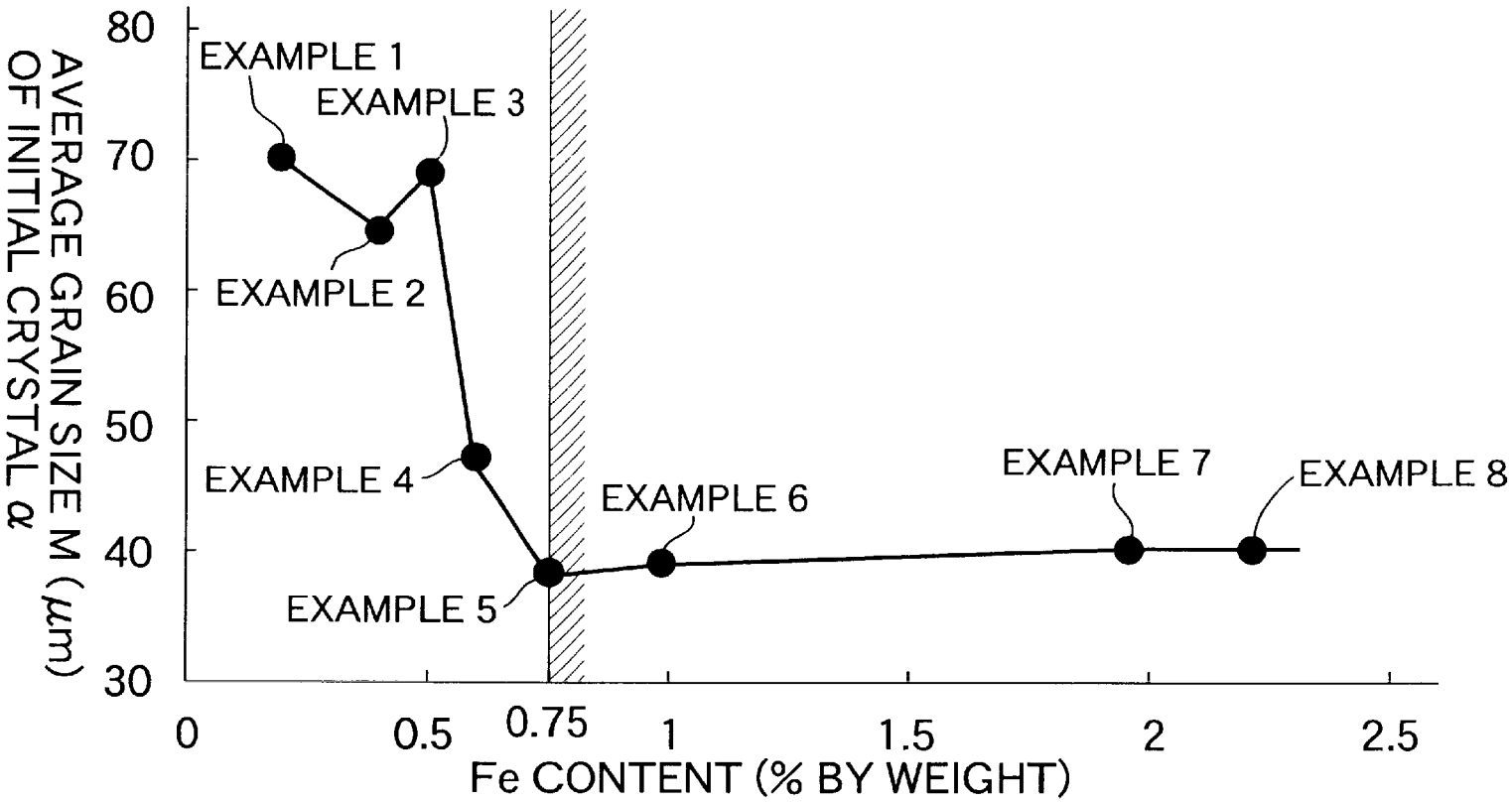
FIG. 10 is a graph showing the relationship between the Fe content and the average grain size M of initial crystals $\alpha$.
Figure 11:
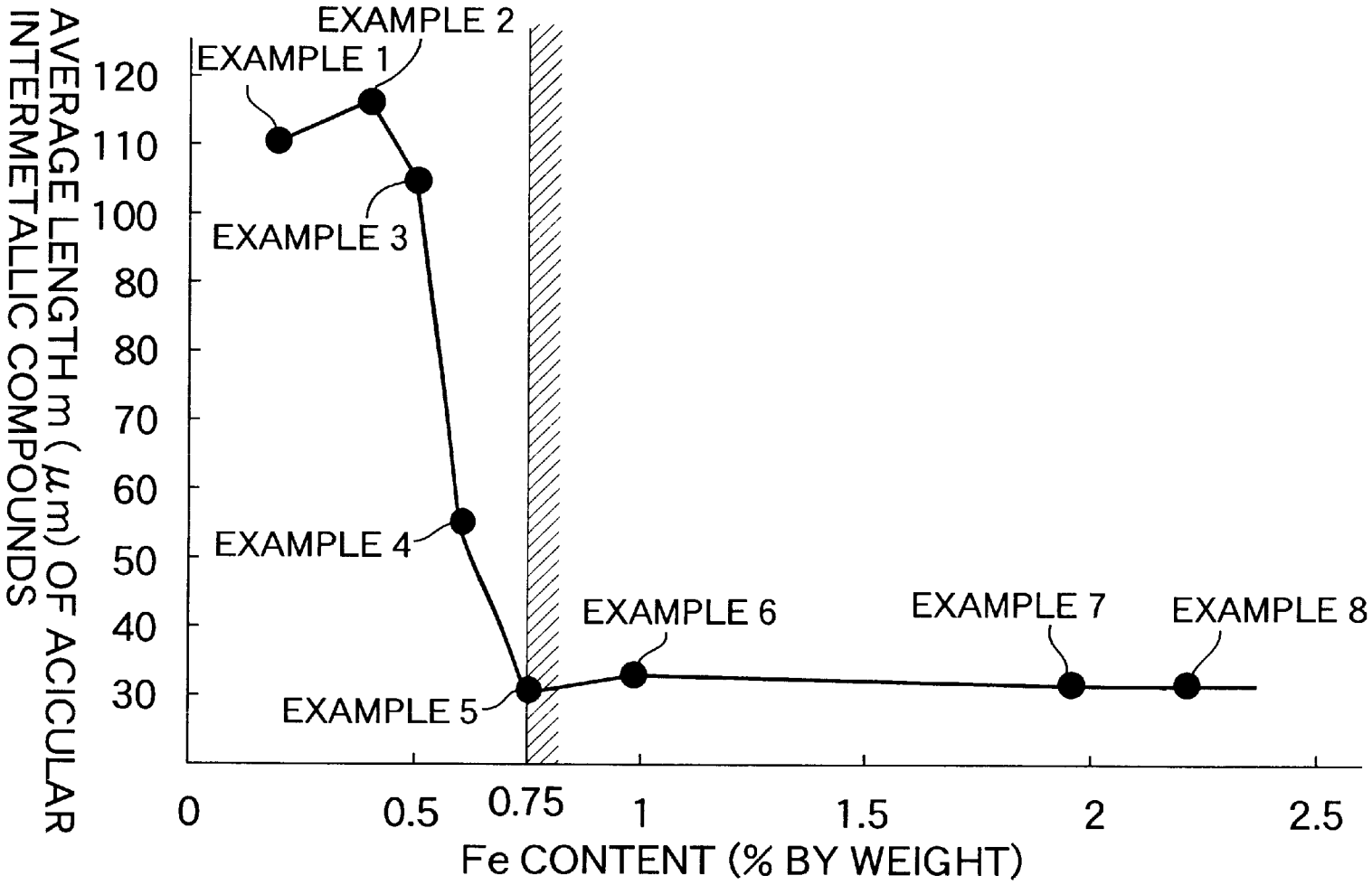
FIG. 11 is a graph showing the relationship between the Fe content and the average length m of acicular intermetallic compounds.

FIGS. 10 and 11 are graphs taken from Table 2 and showing the relationship between the Fe content, the average grain size M of the initial crystals α and the average length m of the acicular intermetallic compound, respectively. It can be seen from FIGS. 10 and 11 that if the Fe content is set at Fe≧0.75% by weight, the initial crystals a and the acicular intermetallic compound are finely divided to a sufficient extent.

(2) Examples 1, 4, 8, and 9 to 17 of the ingots I were subjected to a Charpy impact test to provide results given in Table 3. In this test, a test piece having a U-shaped notch having a depth of 2 mm (a JIS No.3 test piece) was used.

TABLE 3

| Ingot | Fe content X (% by weight) | Charpy impact value ($J/cm^2$) |
|---|---|---|
| Example 9 | 0.10 | 2.20 |
| Example 1 | 0.20 | 2.00 |
| Example 10 | 0.40 | 1.60 |
| Example 4 | 0.60 | 1.40 |
| Example 11 | 0.80 | 1.13 |
| Example 12 | 1.00 | 0.99 |
| Example 13 | 1.30 | 0.82 |
| Example 14 | 1.40 | 0.78 |
| Example 15 | 1.60 | 0.68 |
| Example 16 | 1.90 | 0.62 |
| Example 17 | 2.00 | 0.12 |
| Example 8 | 2.20 | 0.09 |

Figure 12:
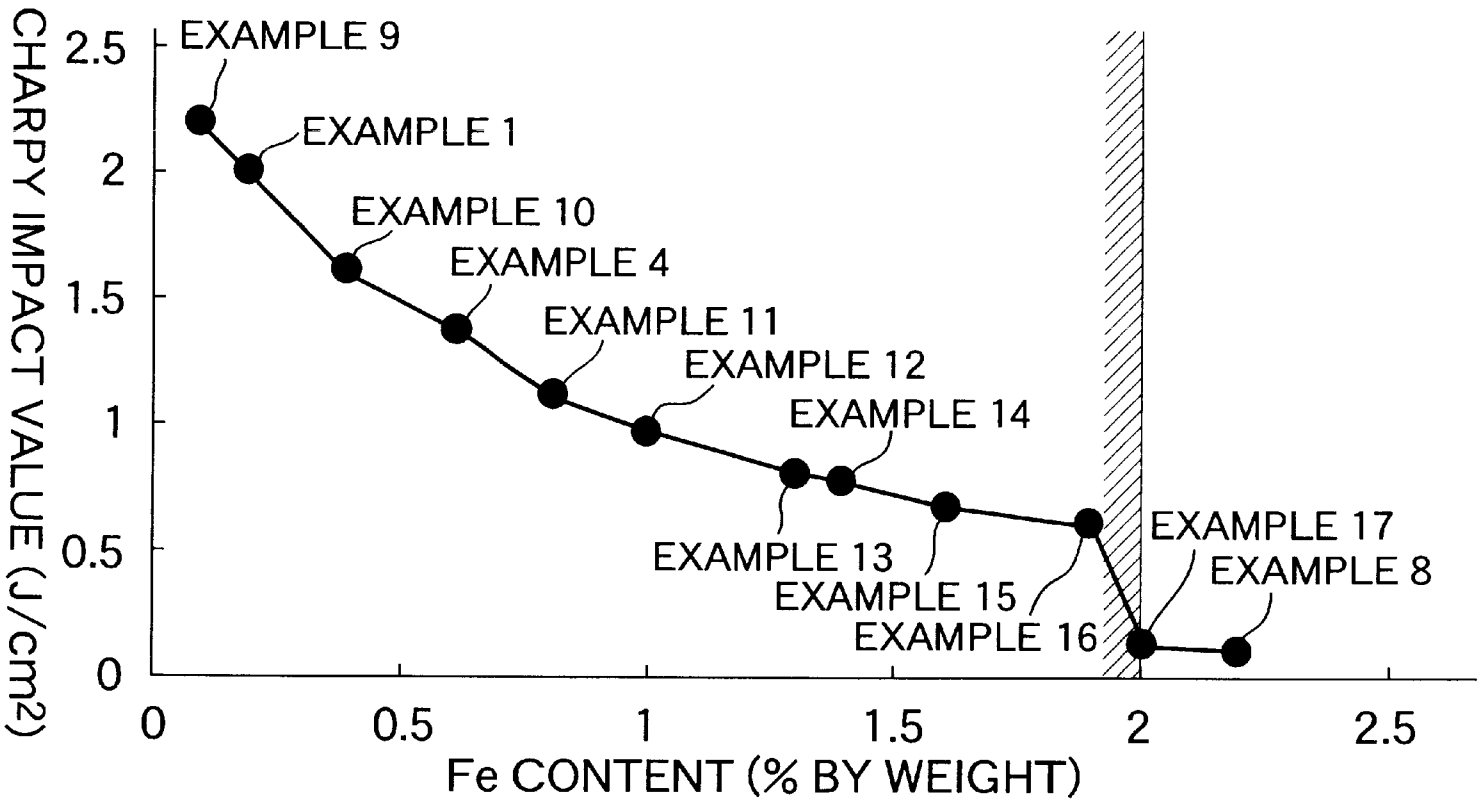
FIG. 12 is a graph showing the relationship between the Fe content and the Charpy impact value.

FIG. 12 is a graph taken from Table 3 and showing the relationship between the Fe content and the Charpy impact value. As apparent from FIG. 12, if the Fe content is equal to or higher than 2.0% by weight, the Charpy impact value of the ingot I is remarkably low. Therefore, the Fe content is set lower than 2.0% by weight.

(3) If the molten metal agitating area forming portion e of the inner peripheral surface d of the spout is formed into the tapered shape, as described above, the molten metal agitating area A is enlarged. Therefore, a large number of the Fe-based intermetallic compounds can be crystallized, and the fine-division of the acicular intermetallic compound and the like by the Fe-based intermetallic compounds can be performed to a sufficient extent.

[B] Mn and Cr contents

When the Mn content is set in a range of a/2≦Mn≦a and the Cr content is set in a range of a/10≦Cr≦a/4 wherein a represents the Fe content in the aluminum alloy having the Fe content set in the above-described range, the corner of the Fe-based intermetallic compound is of an acute angle. If such an Fe-based intermetallic compound is crystallized, the pulverization of the acicular intermetallic compound can be promoted, whereby the fine-division thereof can be further enhanced.

Table 4 shows the composition of an aluminum alloy which is a starting material.

TABLE 4

| Al alloy | Chemical constituent (% by weight) | | | | | | | | | | |
|---|---|---|---|---|---|---|---|---|---|---|---|
| | Cu | Si | Mg | Zn | Fe | Mn | Cr | Ni | Ti | Sr | Balance |
| | 4.8 | 7 | 0.24 | 0.8 | 1 | varied | | 0.1 | 0.2 | 0.03 | Al |

(Molten metals Mm of such aluminum alloys having an Fe content fixed at 1% by weight and Mn and Cr contents varied were prepared, and various ingots I were produced using the continuous casting apparatus 1 under the same casting condition as those described above.

Table 5 shows the Mn and Cr contents and the average length m of the acicular intermetallic compounds in each of examples 1 to 14 of the ingots I.

TABLE 5

| Ingot | Mn content (% by weight) | Cr content (% by weight) | Average length m of acicular intermetallic compounds (μm) |
|---|---|---|---|
| Example 1 | 0.4 | 0.10 | 50 |
| Example 2 | 0.4 | 0.25 | 47 |
| Example 3 | 0.5 | 0.09 | 43 |
| Example 4 | 0.5 | 0.10 | 30 |
| Example 5 | 0.5 | 0.25 | 28 |
| Example 6 | 0.5 | 0.30 | 48 |
| Example 7 | 0.6 | 0.20 | 27 |
| Example 8 | 0.9 | 0.15 | 30 |
| Example 9 | 1.0 | 0.09 | 45 |
| Example 10 | 1.0 | 0.10 | 30 |
| Example 11 | 1.0 | 0.25 | 29 |
| Example 12 | 1.0 | 0.30 | 50 |
| Example 13 | 1.2 | 0.10 | 50 |
| Example 14 | 1.2 | 0.25 | 40 |

Figure 13:
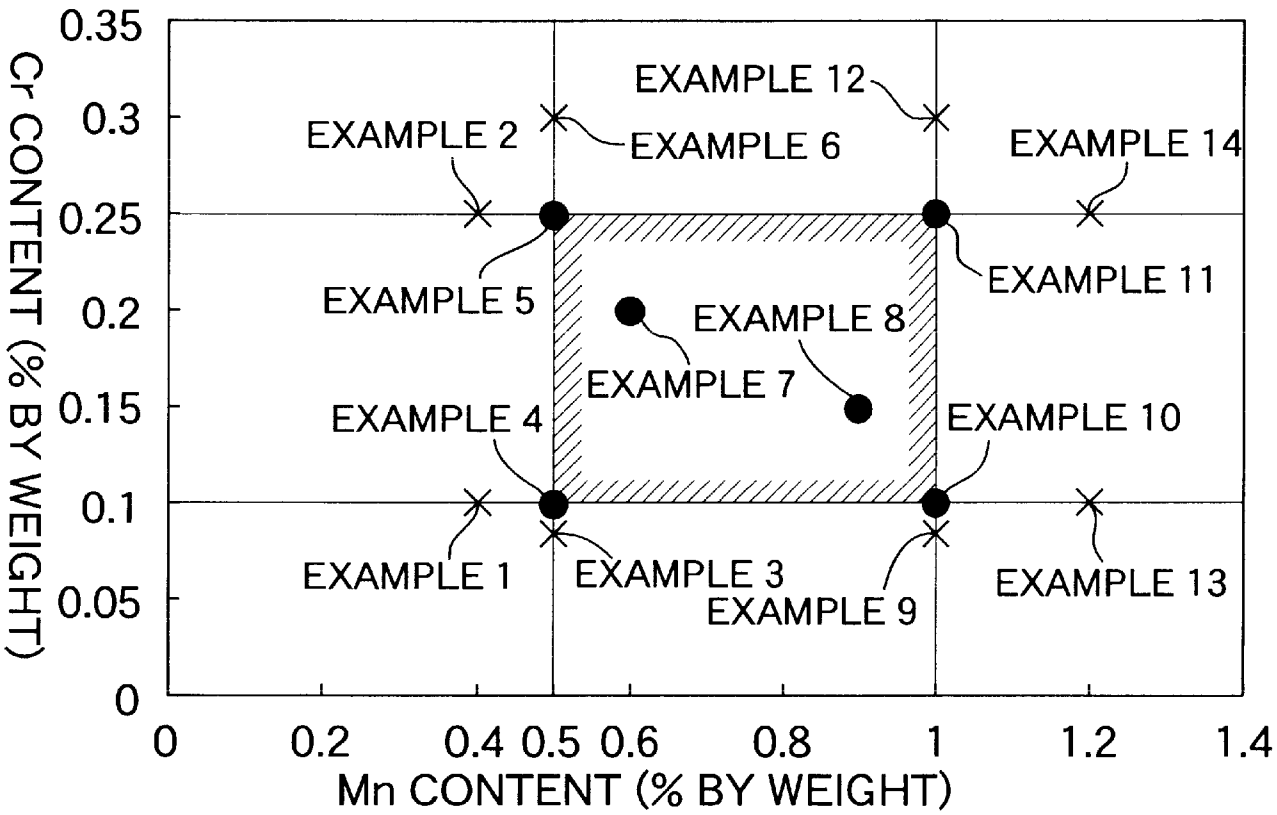
FIG. 13 is a graph showing the relationship between the Mn and Cr contents.

FIG. 13 is a graph taken from Table 5 and showing the relationship between the Mn and Cr contents. As apparent from Table 5 and FIG. 13, if the Mn content is set in a range of 0.5% by weight (a/2)≦Mn≦1.0% by weight (a) and the Cr content is set in a range of 0.1% by weight (a/10)≦Cr≦0.25% by weight (a/4) at the Fe content of 1% by weight (a), the average length m of the acicular intermetallic compounds can be reduced to 30 μm or less, as in examples 4, 5, 7, 8, 10 and 11.

[C] Average Cooling Speed MCR of Molten Metal and Magnetic Flux Density B

In the continuous casting apparatus 1 having the above-described arrangement, if the average cooling speed MCR of the molten metal Mm contacting the molten metal agitating area forming portion e of the inner peripheral surface d of the spout is set in a range of 0.5° C./sec≦MCR≦20° C./sec and the magnetic flux density B in the molten metal agitating area forming portion e is set in a range of 100 Gs≦B<500 Gs, those of the Fe-based intermetallic compounds which have an acute angle can be produced in an amount of 90% or more to promote the fine-division of the acicular intermetallic compound.

Table 6 shows the composition of an aluminum alloy which is a starting material.

TABLE 6

| Al alloy | Chemical constituent (% by weight) | | | | | | | | | | |
|---|---|---|---|---|---|---|---|---|---|---|---|
| | Cu | Si | Mg | Zn | Fe | Mn | Cr | Ni | Ti | Sr | Balance |
| | 4.8 | 7 | 0.24 | 0.8 | 0.85 | 0.67 | 0.12 | 0.1 | 0.2 | 0.03 | Al |

A molten metal Mm of such aluminum alloy composition was prepared, and various ingots I were produced using the continuous casting apparatus 1 under substantially the same conditions as those described above, except that the magnetic flux density B and the average cooling speed MCR of the molten metal Mm were varied. In this case, as shown in FIGS. 1 and 2, the variation of the average cooling speed MCR was performed by forming the molten metal agitating area forming portion e into the curved surface and varying the protrusion amount Δr of the spout 15 at an inside diameter $D_1$=76 mm and a height H=142 mm of the molten metal receiving port 21 of the spout 15 and the inside diameter $D_2$=152 mm of the water-cooled casting mold 13.

Table 7 shows the protrusion amount Δr, the average cooling speed MCR, the magnetic flux density B and the presence rate of the Fe-based intermetallic compounds having the acute angle with regard to examples 1 to 15 of the ingots I.

TABLE 7

| Ingot | Protrusion amount Δr (m) | Average cooling speed MCR (° C./sec) | Magnetic flux density B (Gs) | Presence rate of Fe-based intermetallic compounds having acute angle (%) |
|---|---|---|---|---|
| Example 1 | 0 | 24 | 100 | 68 |
| Example 2 | 1 | 20 | 90 | 84 |
| Example 3 | 1 | 20 | 100 | 90 |
| Example 4 | 1 | 20 | 310 | 90 |
| Example 5 | 1 | 20 | 360 | 92 |
| Example 6 | 1 | 20 | 490 | 94 |
| Example 7 | 1 | 20 | 500 | uncastable |
| Example 8 | 2 | 10 | 200 | 90 |
| Example 9 | 5 | 5 | 400 | 92 |
| Example 10 | 10 | 2 | 150 | 92 |
| Example 11 | 20 | 0.8 | 300 | 94 |
| Example 12 | 36 | 0.5 | 100 | 96 |
| Example 13 | 36 | 0.5 | 490 | 95 |
| Example 14 | 45 | 0.44 | 100 | 85 |
| Example 15 | 45 | 0.1 | 100 | 85 |

In the case of example 7, the electromagnetic agitating force applied to the molten metal Mm was too large and for this reason, the molten metal Mm was caused to enter a lubricating oil outlet 44, whereby making the casting of the molten metal was made impossible.

Figure 14:
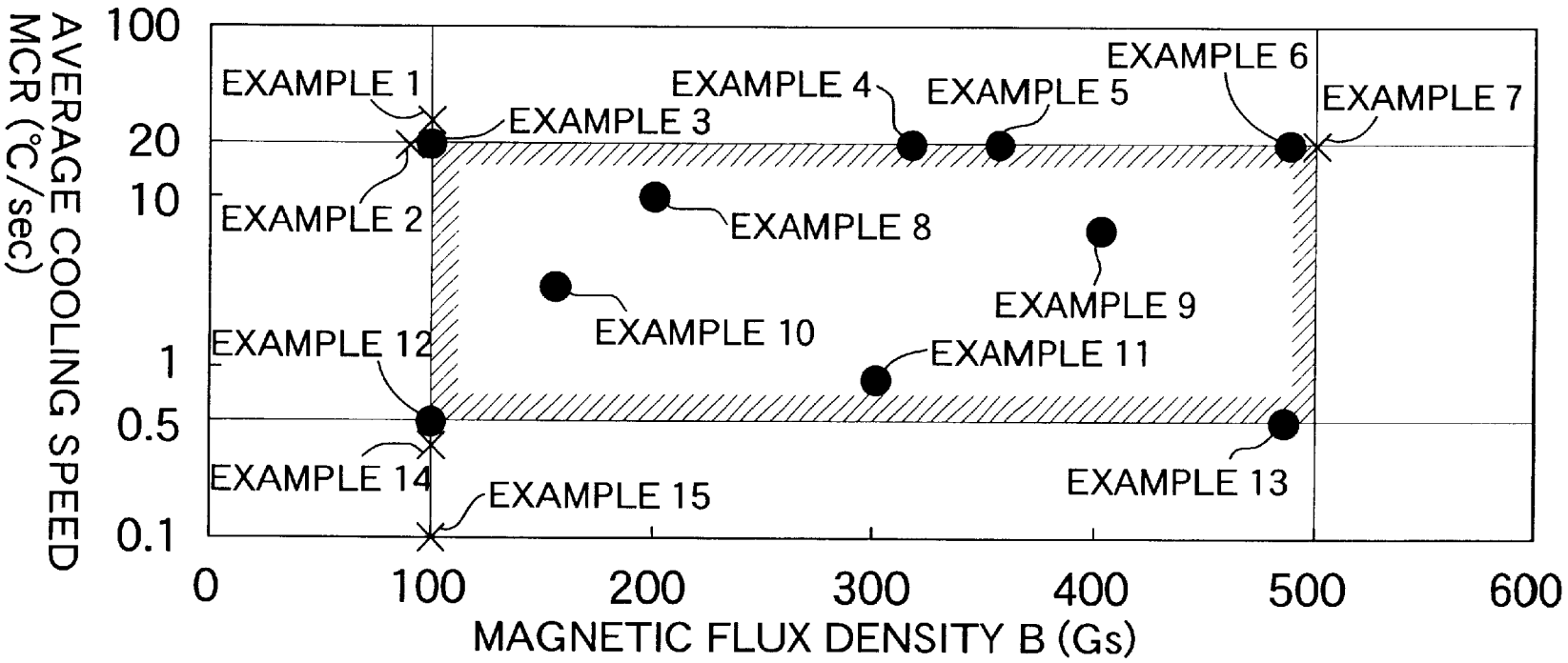
FIG. 14 is a graph showing the relationship between the magnetic flux density and the average cooling speed MCR.

FIG. 14 is a graph taken from Table 7 and showing the relationship between the magnetic flux density B and the average cooling speed MCR. The acicular intermetallic compound can be finely divided into an average length of 50 μm or less by setting the magnetic flux density B and the average cooling speed MCR in a range of 0.5° C./sec≦MCR≦20° C./sec and in a range of 100 Gs≦B≦500 Gs, respectively, in FIG. 14.

[Embodiment II]

Even in this embodiment, the continuous casting apparatus 1 shown in FIGS. 1 and 2 is used.

A molten metal Mm of an aluminum alloy composition used, is a molten metal having an Fe content in a range of 0.75% by weight ≦Fe<2% by weight; a molten metal having an Mn content being set at Mn≦[(Fe/5)+0.2]% by weight when the Fe content is in a range of 0.75% by weight ≦Fe≦1.5% by weight; and a molten metal having an Mn content being set at Mn≦[−Fe+2]% by weight when the Fe content is in a range of 1.5% by weight <Fe<2% by weight. The cooling speed CR of the molten metal Mm in the upper peripheral edge f of the molten metal agitating area forming portion e on the inner peripheral surface d of the spout is set in a range of 10° C./sec≦CR≦30° C./sec.

If the Fe and Mn contents are set in the above-described ranges, it is possible to suppress the amount of α-intermetallic compounds crystallized to an unavoidable amount. The upper peripheral edge f is a site where the cooling speed of the molten metal Mm is slowest. If the cooling speed CR of the molten metal Mm in the upper peripheral edge f is set in the above-described range, it is possible to suppress the growth of α-intermetallic compounds. Thus, the amount of fine β-intermetallic compounds crystallized can be increased to an upper limit value. The α-intermetallic compounds crystallized contribute to the pulverization and fine-division of a coalesced acicular intermetallic compound and the initial crystal α.

EXAMPLE 1

Table 8 shows the composition of each of the aluminum alloys(1) to (12) and the upper limit value of Mn content. The upper limit value is Mn=[(Fe/5)+0.2]% by weight, when the Fe content is in a range of 0.75% by weight ≦Fe≦1.5% by weight; while being Mn=[−Fe+2]% by weight, when the Fe content is in a range of 1.5% by weight <Fe<2% by weight.

TABLE 8

| Aluminum alloy | Chemical constituent (% by weight) | | | | | | | | | | | Upper limit value of Mn content (% by weight) |
|---|---|---|---|---|---|---|---|---|---|---|---|---|
| | Cu | Si | Mg | Zn | Fe | Mn | Cr | Ni | Ti | Sr | Balance | |
| (1) | 4.4 | 7 | 0.15 | 0.4 | 0.75 | 0.35 | 0.2 | 0.05 | 0.15 | 0.025 | Al | 0.35 |
| (2) | 4.4 | 7.3 | 0.15 | 0.5 | 0.75 | 0.37 | 0.18 | 0.05 | 0.12 | 0.02 | Al | 0.35 |
| (3) | 1.2 | 7.1 | 0.18 | 0.45 | 1 | 0.4 | 0.2 | 0.05 | 0.2 | 0.02 | Al | 0.40 |
| (4) | 4.4 | 7 | 0.18 | 0.5 | 1.2 | 0.1 | 0.21 | 0.06 | 0.1 | 0.02 | Al | 0.44 |
| (5) | 4.4 | 7.5 | 0.18 | 0.5 | 1.2 | 0.46 | 0.2 | 0.07 | 0.1 | 0.02 | Al | 0.44 |
| (6) | 4.4 | 7.2 | 0.18 | 0.5 | 1.4 | 0.5 | 0.18 | 0.05 | 0.12 | 0.02 | Al | 0.48 |

TABLE 8-continued

| Aluminum alloy | Chemical constituent (% by weight) Cu | Si | Mg | Zn | Fe | Mn | Cr | Ni | Ti | Sr | Balance | Upper limit value of Mn content (% by weight) |
|---|---|---|---|---|---|---|---|---|---|---|---|---|
| (7) | 4 | 7 | 0.15 | 0.3 | 1.5 | 0.5 | 0.2 | 0.05 | 0.15 | 0.025 | Al | 0.50 |
| (8) | 4.2 | 7.2 | 0.18 | 0.51 | 1.5 | 0.52 | 0.2 | 0.07 | 0.1 | 0.02 | Al | 0.50 |
| (9) | 4.5 | 7.1 | 0.18 | 0.2 | 1.6 | 0.5 | 0.2 | 0.05 | 0.2 | 0.02 | Al | 0.40 |
| (10) | 4.2 | 7 | 0.13 | 0.5 | 1.67 | 0.33 | 0.21 | 0.06 | 0.1 | 0.024 | Al | 0.33 |
| (11) | 4 | 7 | 0.15 | 0.3 | 1.8 | 0.2 | 0.21 | 0.06 | 0.1 | 0.026 | Al | 0.20 |
| (12) | 4.4 | 7.2 | 0.18 | 0.5 | 1.8 | 0.38 | 0.2 | 0.07 | 0.1 | 0.02 | Al | 0.20 |

Using each of the aluminum alloys (1) to (12), an ingot I was produced in a casting manner by the agitated continuous casting apparatus 1. Casting conditions are as follows: The melting temperature was set at 730° C.; the temperature of the molten metal just above the spout 15 was set at 650° C.; a cast product withdrawing speed was set at 150 mm/min; the protrusion amount Δr of the spout 15 was set at 2 mm; the diameter of the ingot I was 152.4 mm; the magnetic flux density in the molten metal agitating area forming portion e was set at 360 Gs (4-pole coils and 50 Hz); and the cooling speed CR of the molten metal Mm in the upper peripheral edge f was set at 15.5° C./sec.

The presence of α-intermetallic compounds and fine β-intermetallic compounds was examined for each of the ingots I. As a result, the presence of a large amount of fine β-intermetallic compounds was observed in the ingots I made from the aluminum alloys (1), (3), (4), (7), (10) and (11), and the presence of a large amount of the α-intermetallic compounds was observed in the ingots I made from the aluminum alloys (2), (5), (6), (8), (9) and (12).

Figure 15:
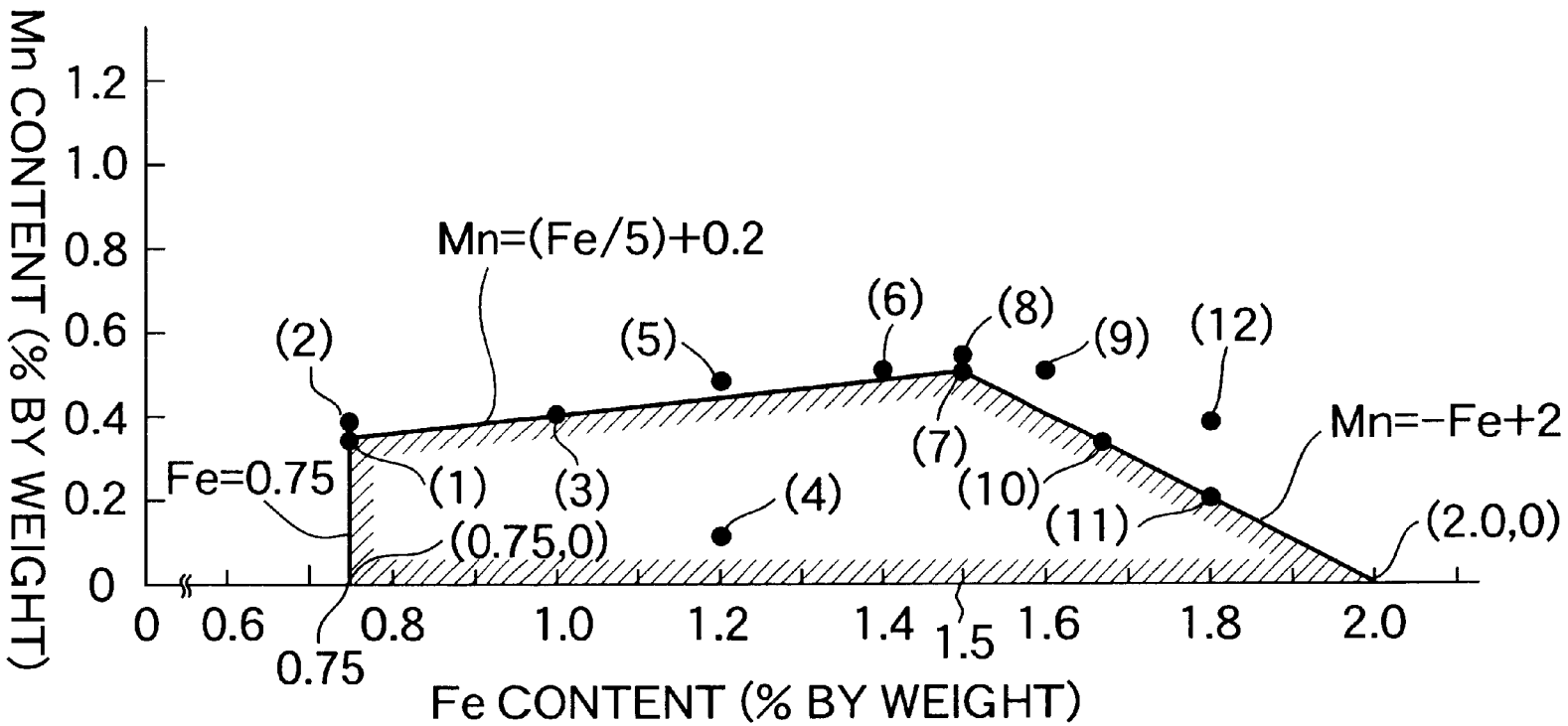
FIG. 15 is a graph showing Fe and Mn contents in each of various aluminum alloys.

FIG. 15 is a graph showing the Fe and Mn contents in the aluminum alloys (1) to (12) with the Fe content taken on the axis of abscissas and the Mn content taken on the axis of ordinates. In FIG. 15, points (1) to (12) correspond to the aluminum alloys (1) to (12), respectively.

From the casting result, it can be said that the inside of a quadrilateral formed by connecting a point (0.75, 0), a point (1), a point (3), a point (7), a point (10), a point (11) and a point (2.0, 0) to one another in FIG. 15, is a region which ensures that a large amount of fine β-intermetallic compounds can be crystallized. In this case, a line Fe=0.75, a line Mn=(Fe/5)+0.2 and a line Mn=−Fe+2 are included in such region, but a line Mn=0 is not included in such region.

EXAMPLE 2

Table 9 shows the composition of an aluminum alloy and the upper limit value of Mn content. The upper limit value is Mn=[(Fe/5)+0.2]% by weight, because the Fe content is in a range of 0.75% by weight ≦Fe≦1.5% by weight.

Using the aluminum alloy, an ingot I was produced in a casting manner by the agitated continuous casting apparatus 1. Casting conditions are as follows: The melting temperature was set at 730° C.; the temperature of the molten metal just above the spout 15 was set at 650° C.; the cast product withdrawing speed was set in a range of 150 to 270 mm/min; the protrusion amount Ar of the spout 15 was set in a range of 2 to 36 mm; the diameter of the ingot I was 152.4 mm; and the magnetic flux density in the molten metal agitating area forming portion e was set at 360 Gs (4-pole coils and 50 Hz). The cooling speed CR of the molten metal Mm in the upper peripheral edge f was varied by changing the cast product withdrawing speed and the protrusion amount Δr of the spout 15 in the above-described ranges, respectively.

The presence rates and rheologic properties of α-intermetallic compounds and fine β-intermetallic compounds were examined for each of the ingots I to provide results given in Table 10. In Table 10, α-IMC indicates the α-intermetallic compound, and β-IMC indicates the fine β-intermetallic compound. The presence rate $D_1$ of the α-intermetallic compounds and the presence rate $D_2$ of the fine β-intermetallic compounds were determined according to equations, $D_1=\{d_1/(d_1+d_2)\}\times 100$ and $D_2=\{d_2/(d_1+d_2)\}\times 100$, wherein $d_1$ represents an area rate of the α-intermetallic compounds in a field of view by a metal microscope of 100 magnification, and $d_2$ represents an area rate of the fine β-intermetallic compounds.

Figure 16:
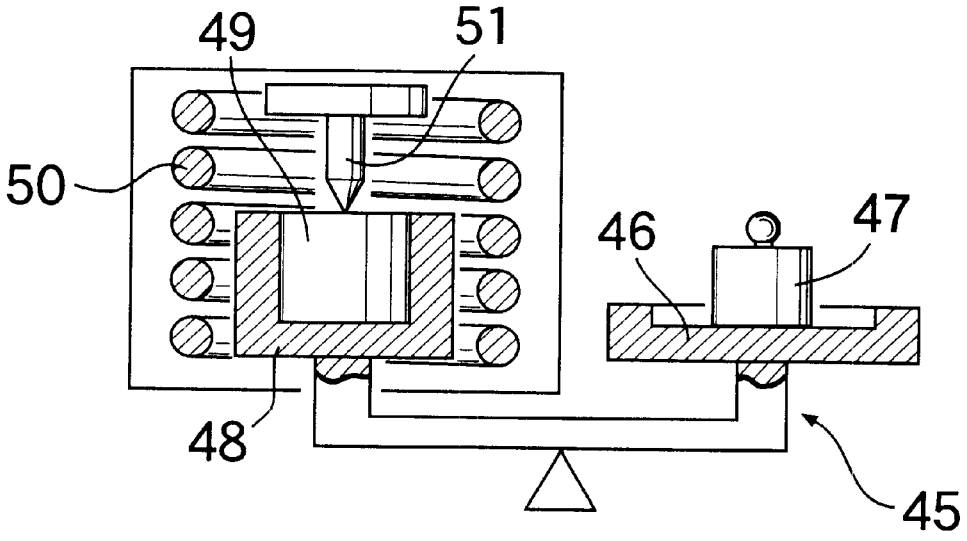
FIG. 16 is a view for explaining a method for measuring a TMA temperature.

To examine the rheologic property, a test piece having a diameter of 3 mm and a thickness of 2 mm was cut away from each of the ingots I. As shown in FIG. 16, a weight 47 of 20 g was placed onto a dish 46 of a balance 45, and a test piece 49 was fitted into a vessel 48 of the balance 45. Then, the test piece 49 was heated by a heater 50, and a pin 51 having a diameter of 1 mm and a length of 2 mm was pushed against the test piece 49, whereby a temperature at the time when the pin 51 was stuck into the test piece 49 by a pushing pressure keeping a balance with the weight 47 of 20 g, namely, a TMA temperature was measured.

TABLE 9

| Aluminum alloy | Chemical constituent (% by weight) Cu | Si | Mg | Zn | Fe | Mn | Cr | Ni | Ti | Sr | Balance | Upper limit value of Mn content (% by weight) |
|---|---|---|---|---|---|---|---|---|---|---|---|---|
| | 4.4 | 7 | 0.18 | 0.5 | 0.75 | 0.1 | 0.2 | 0.05 | 0.15 | 0.02 | Al | 0.35 |

TABLE 10

| Example | Cooling speed Cr (° C./sec) | Presence rate (%) α-IMC | Presence rate (%) β-IMC | TMA temperature (° C.) |
|---|---|---|---|---|
| 1 | 0.2 | 100 | 0 | 590 |
| 2 | 0.6 | 100 | 0 | 588 |
| 3 | 0.8 | 100 | 0 | 590 |
| 4 | 0.95 | 100 | 0 | 590 |
| 5 | 1 | 100 | 0 | 591 |
| 6 | 5 | 100 | 0 | 590 |
| 7 | 9.4 | 60 | 40 | 591 |
| 8 | 10 | 5 | 95 | 588 |
| 9 | 15 | 5 | 95 | 590 |
| 10 | 20 | 5 | 95 | 592 |
| 11 | 22 | 5 | 95 | 592 |
| 12 | 30 | 5 | 95 | 590 |
| 13 | 32 | 5 | 95 | 600 |

As apparent from Table 10, if the cooling speed CR is set in a range of 10° C./sec≦CR≦30° C./sec, as shown in examples 8 to 12 the presence rate of α-intermetallic compounds can be suppressed to 5%, namely, the amount of α-intermetallic compounds crystallized can be suppressed to an inevitable amount, whereby the presence rate of fine β-intermetallic compounds can be increased to 95%, namely, the amount of fine β-intermetallic compounds crystallized can be increased to an upper limit value.

A TMA temperature for an ingot produced without agitation from an aluminum alloy having the same composition as in Table 9 is 600° C., and hence, this ingot has a poor rheologic property and cannot be used as a thixocasting material. A TMA temperature for each of examples 8 to 12 produced in a casting manner within the above-described range of cooling speed CR is lower than 600° C. and hence, each of examples 8 to 12 has a good rheologic property.

Then, a thixocasting process was carried out using examples 5 and 8 to produce two aluminum alloy members. Casting conditions are as follows: The temperature of the casting material was set at 580° C.; the injection speed was set at 2.0 m/sec; and the temperature of a mold was set at 250° C.

Figure 17:
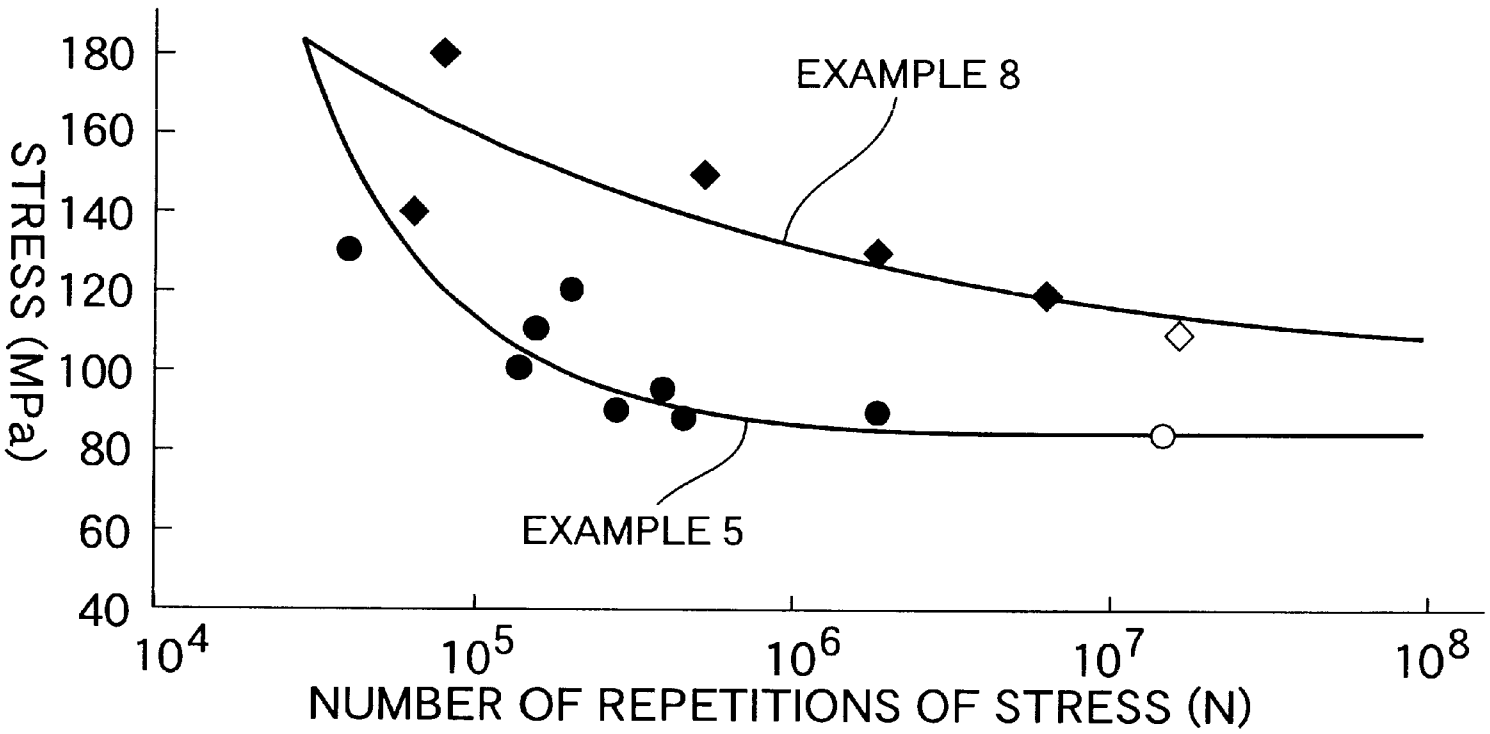
FIG. 17 is a graph showing results of a fatigue test.

A test piece was fabricated from each of the aluminum alloy members and subjected to a tension and compression fatigue test to provide results given in FIG. 17. In FIG. 17, examples 5 and 8 correspond to the examples 5 and 8 of the ingots. As apparent from FIG. 17, if example 8 having a large amount of fine β-intermetallic compounds is used, an aluminum alloy member having an excellent fatigue strength can be produced, as compared with the case where example 5 having only α-intermetallic compounds is used.

[Embodiment III]

Even in this embodiment, the agitated continuous casting apparatus 1 shown in FIGS. 1 and 2 is used.

A molten metal m of an aluminum alloy composition used, is a molten metal having an Fe content in a range of [3/4]% by weight ≦Fe≦[5/3]% by weight, and a molten metal having an Mn content in a range of [Fe/5]% by weight ≦Mn≦[−Fe+2]% by weight. When the Fe content is taken on an axis of x and the Mn content is taken on an axis of yin FIG. 18, a triangular region surrounded by a line Fe=3/4, a line Mn=Fe/5 and a line Mn=−Fe+2, is a range of composition of the aluminum alloy. However, the composition on the line Mn=−Fe+2 is not included in such range of composition.

Referring to FIG. 1, when the molten metal Mm having the above-described aluminum alloy composition is supplied from the molten metal supply port 20 in the molten metal supply tub 19 into the spout 15, the molten metal Mm, while being electro-magnetically agitated within the spout 15 by the agitator 23, is introduced into the water-cooled casting mold 13 disposed just below the spout 15, where it is cooled in the water-cooled casting mold 13, thereby providing an ingot I. In this casting course, the magnetic flux density B in the molten metal agitating area forming portion e on the inner peripheral surface d of the spout is set in a range of 100 Gs≦B<500 Gs, and the magnetic flux density $B_1$ in the center zone h of the molten metal agitating area A is set at $B_1$≦20 Gs (including $B_1$=0 Ga).

If the Fe content in the molten metal Mm having the aluminum alloy composition is specified as described above, hard Fe-based intermetallic compounds are crystallized as a primary crystallized product at a temperature equal to or higher than a temperature of crystallization of an initial crystal a in the vicinity of the molten metal agitating area forming portion e on the inner peripheral surface d of the spout. In this case, when the Mn content is in the above-described range, the Fe-based intermetallic compounds are liable to be agglomerated.

Thereupon, the magnetic flux density B in the molten metal agitating area forming portion e is set in the above-described range to intensify the electromagnetic agitating force applied to the molten metal Mm lying in the vicinity of the forming portion e. Therefore, the dispersion of the Fe-based intermetallic compounds is positively performed, whereby the agglomeration of the Fe-based intermetallic compounds is suppressed to a large extent. Thus, a sufficient pulverizing and finely-dividing effect can be achieved by the Fe-based intermetallic compounds.

On the other hand, if the magnetic flux density $B_1$ in the center zone h of the molten metal agitating area A is specified as described above, the flowing of the molten metal Mm in the center zone h which is a zone of final solidification of the ingot I, can be suppressed to the utmost to avoid the segregation of various types of intermetallic compounds and the like.

The control of the magnetic flux densities B and $B_1$ as described above is achieved easily by the electromagnetic induction-type agitator 23 including 4-pole coils.

Figure 19:
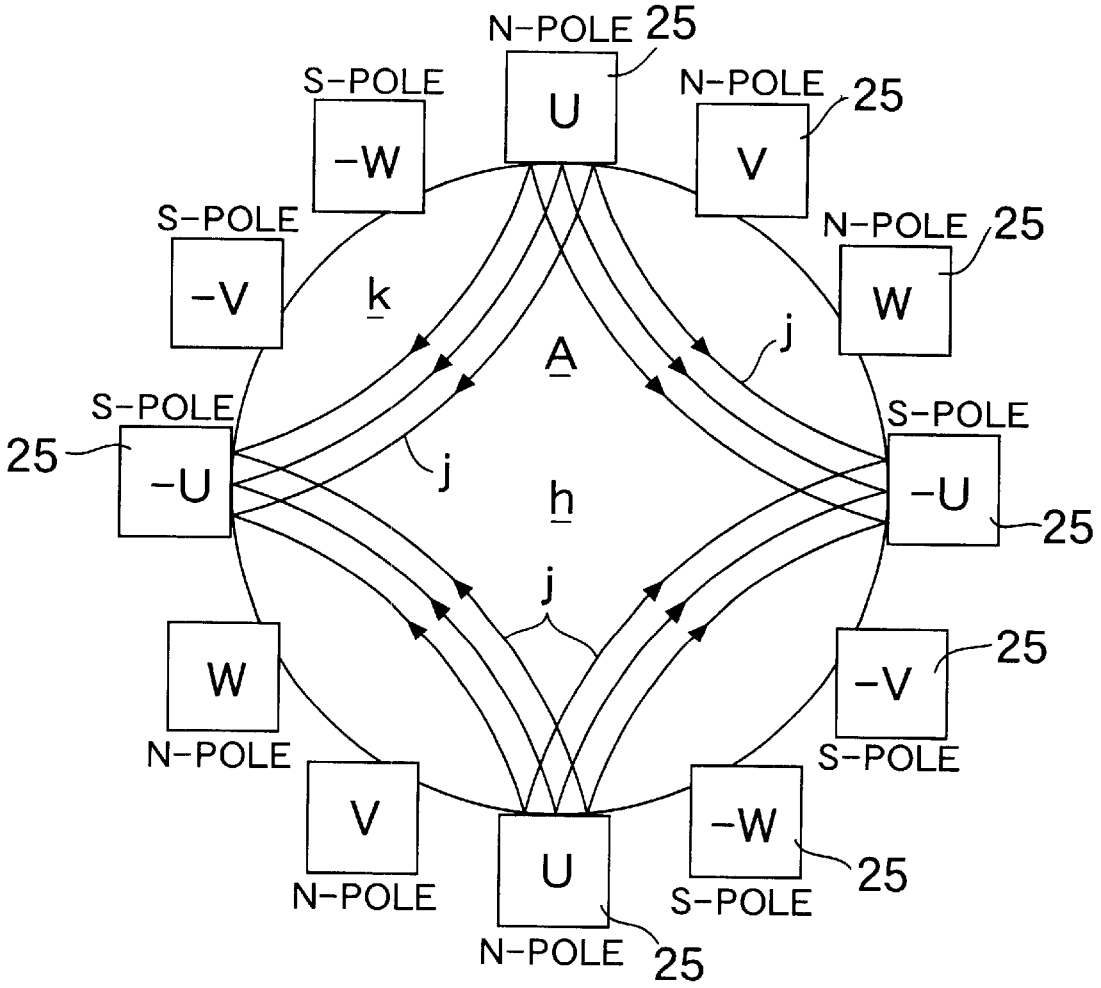
FIG. 19 is a diagram for explaining the formation of magnetic flux by 4-pole coils.

FIG. 19 shows a magnetic flux profile provided at a certain moment by twelve 4-pole coils connected to a three-phase power source (U, V, W). In the case of this magnetic flux profile, magnetic force lines j exist in an outer peripheral zone k of the molten metal agitating area A, but little exist in the central zone h. Therefore, the magnetic flux density is high in the molten metal agitating area forming portion e on the inner peripheral surface d of the spout, but is extremely low or zero in the center zone h.

Figure 20:
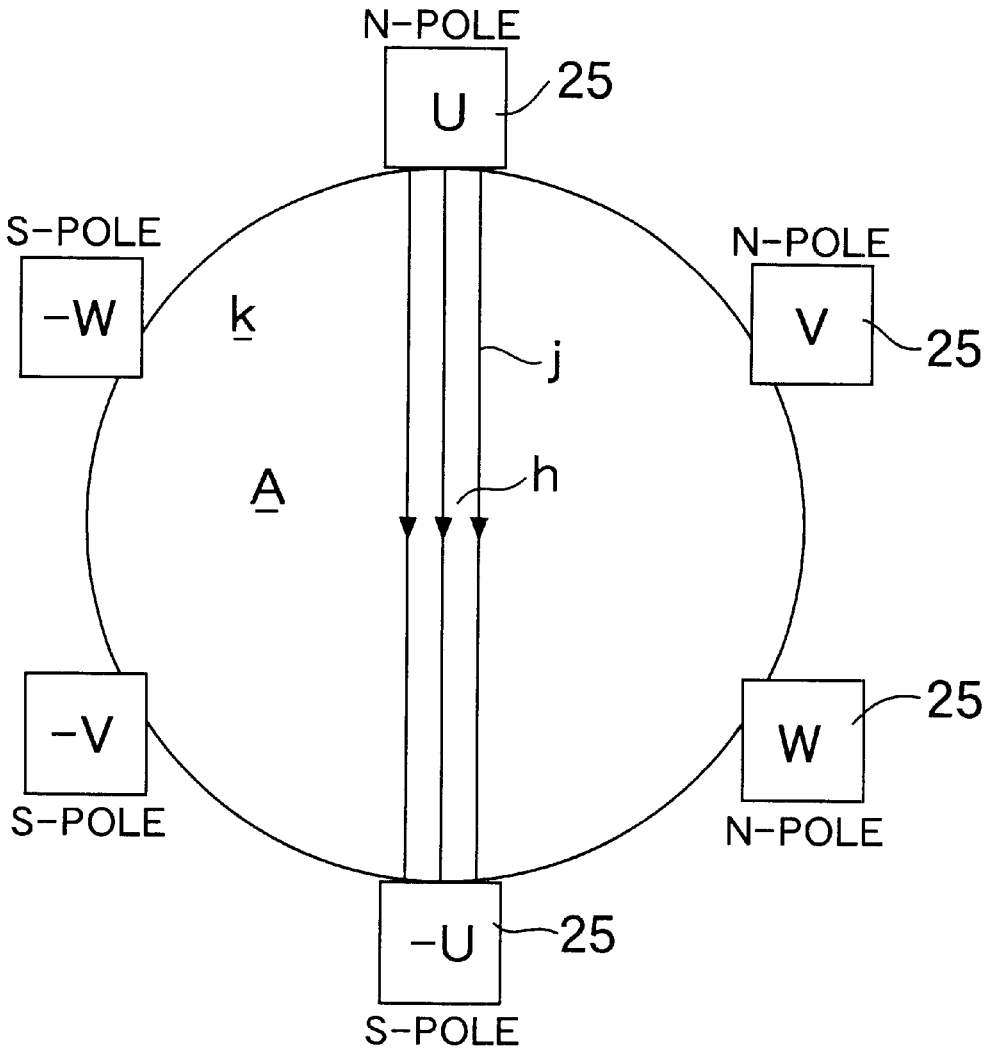
FIG. 20 is a diagram for explaining the formation of magnetic flux by 2-pole coils.

FIG. 20 shows a magnetic flux profile provided at a certain moment by six 2-pole coils connected to a three-phase power source (U, V, W). In the case of this magnetic flux profile, magnetic force lines j necessarily exist in the center zone h of the molten metal agitating area A and hence, the high magnetic flux density in the center zone h causes the molten metal Mm to flow, thereby generating the segregation of intermetallic compounds.

A difference between the characteristics of such 4-pole and 2-pole coils was confirmed from an experiment which will be described below. A short column made of an aluminum alloy having an electric resistance p of $1.38\times10^{-7}$ Ω·m and a diameter of 152 mm was prepared. An electric induction-type agitator having 4-pole coils was placed on an outer periphery of the short column, and electric current of 30 A and 50 Hz is allowed to flow from the three-phase power source to each of the coils. In this manner, the relationship between that position on the radius of the short column which is spaced at a certain distance apart from the outer peripheral surface of the short column and the magnetic flux density in this position was examined. An experiment similar to that described above was carried out using an electric induction-type agitator having 2-pole coils, whereby the relationship between the above-described position and the magnetic flux density in this position was examined.

Figure 21:
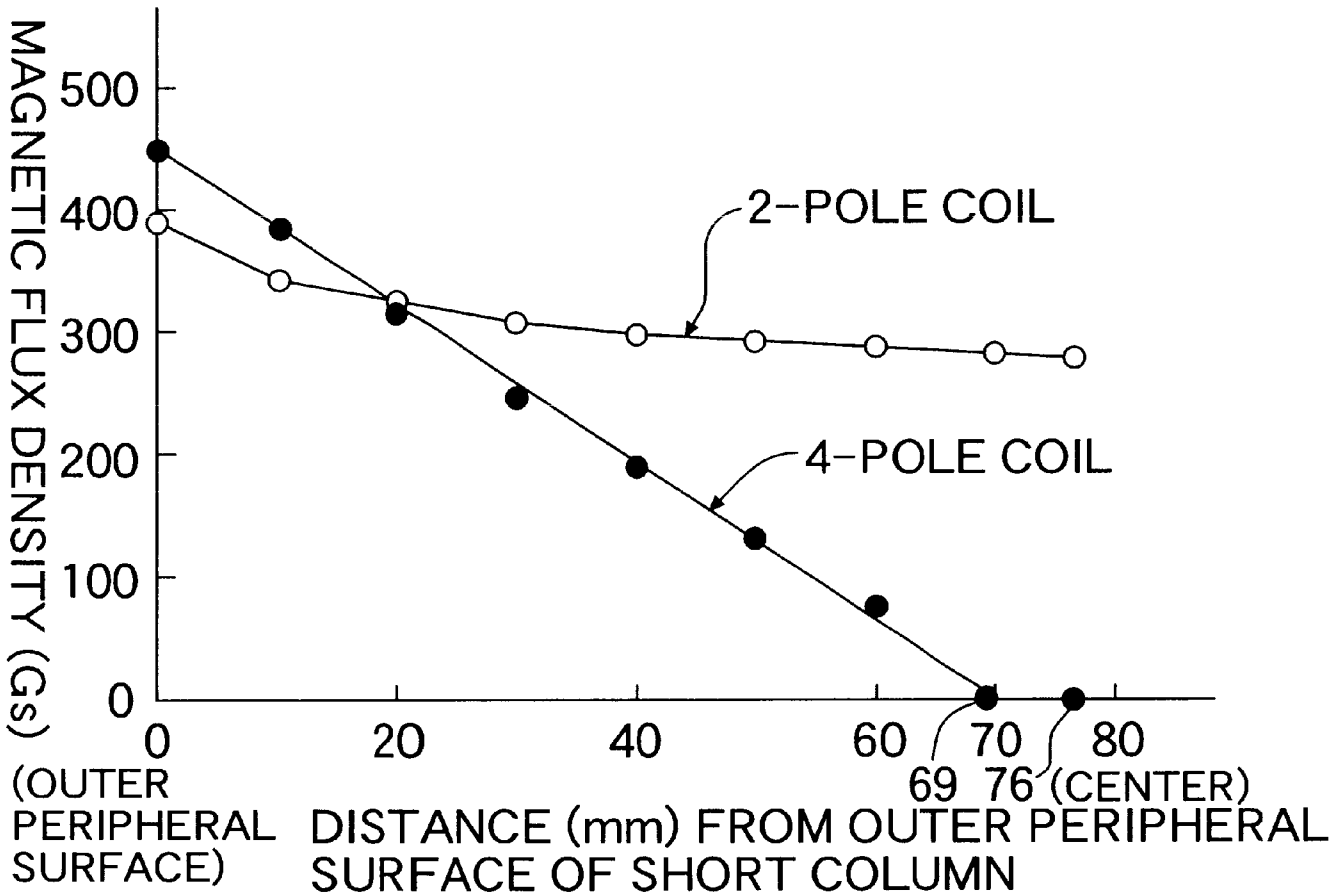
FIG. 21 is a graph showing the relationship between the distance from an outer peripheral surface of a short column and the magnetic flux density.

FIG. 21 shows results of the experiments. As apparent from FIG. 21, when the 4-pole coil is used, the magnetic flux density is decreased proportionally from an outer peripheral surface of the short column toward a position which is about 69 mm spaced apart from the outer peripheral surface, and becomes zero at such position. This applies to a position which is the center and 76 mm spaced apart from the outer peripheral surface. Therefore, when the 4-pole coil is used, a center zone h with a magnetic flux density being zero appears. On the other hand, when the 2-pole coil is used, the magnetic flux density is little decreased in any position spaced apart from the outer peripheral surface and hence, it is obvious that a high magnetic flux density exists even in the center zone h.

EXAMPLE 1

Table 11 shows the composition of example (1) of an aluminum alloy.

TABLE 11

| Example (1) of aluminum alloy | Chemical constituent (% by weight) | | | | | | | | | | |
|---|---|---|---|---|---|---|---|---|---|---|---|
| | Cu | Si | Mg | Zn | Fe | Mn | Cr | Ni | Ti | Sr | Balance |
| | 4.8 | 7 | 0.24 | 0.8 | 0.85 | 0.67 | 0.12 | 0.1 | 0.2 | 0.03 | Al |

Figure 18:
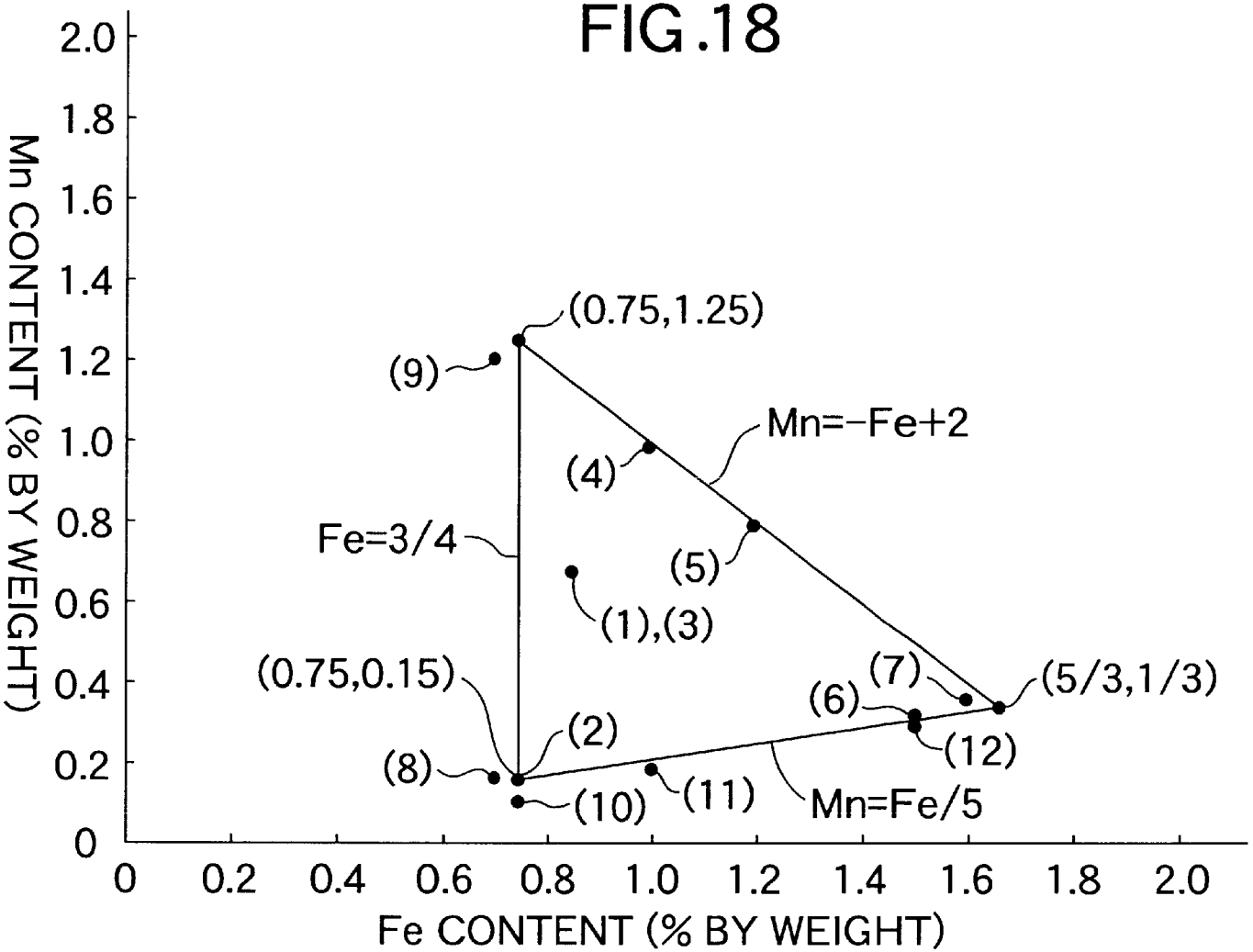
FIG. 18 is a graph showing the Fe and Mn contents in each of various aluminum alloys.

The Mn and Fe contents in this example (1) are put in a triangular region as shown by a point (1) in FIG. 18.

Using the example (1) of the aluminum alloy, an ingot I was produced in a casting manner by the agitated continuous casting apparatus 1. Casting conditions are as follows: The melting temperature was set at 730° C.; the temperature of the molten metal immediately above the spout 15 was set at 650° C.; the cast product withdrawing speed was set at 150 mm/min; the protrusion amount Δr of the spout 15 was set at 2 mm; the diameter of the ingot I was 152.4 mm; the magnetic flux density in the molten metal agitating area forming portion e was set at 360 Gs (4-pole coils and 50 Hz); and the average cooling speed of the molten metal Mm in the molten metal agitating area forming portion e was set at 10° C./sec.

For comparison, an ingot I was produced in a casting manner under the same condition using an agitated continuous casting apparatus having the same structure as in the above-described apparatus, except that 2-pole coils were used in place of the 4-pole coils.

Figure 22:
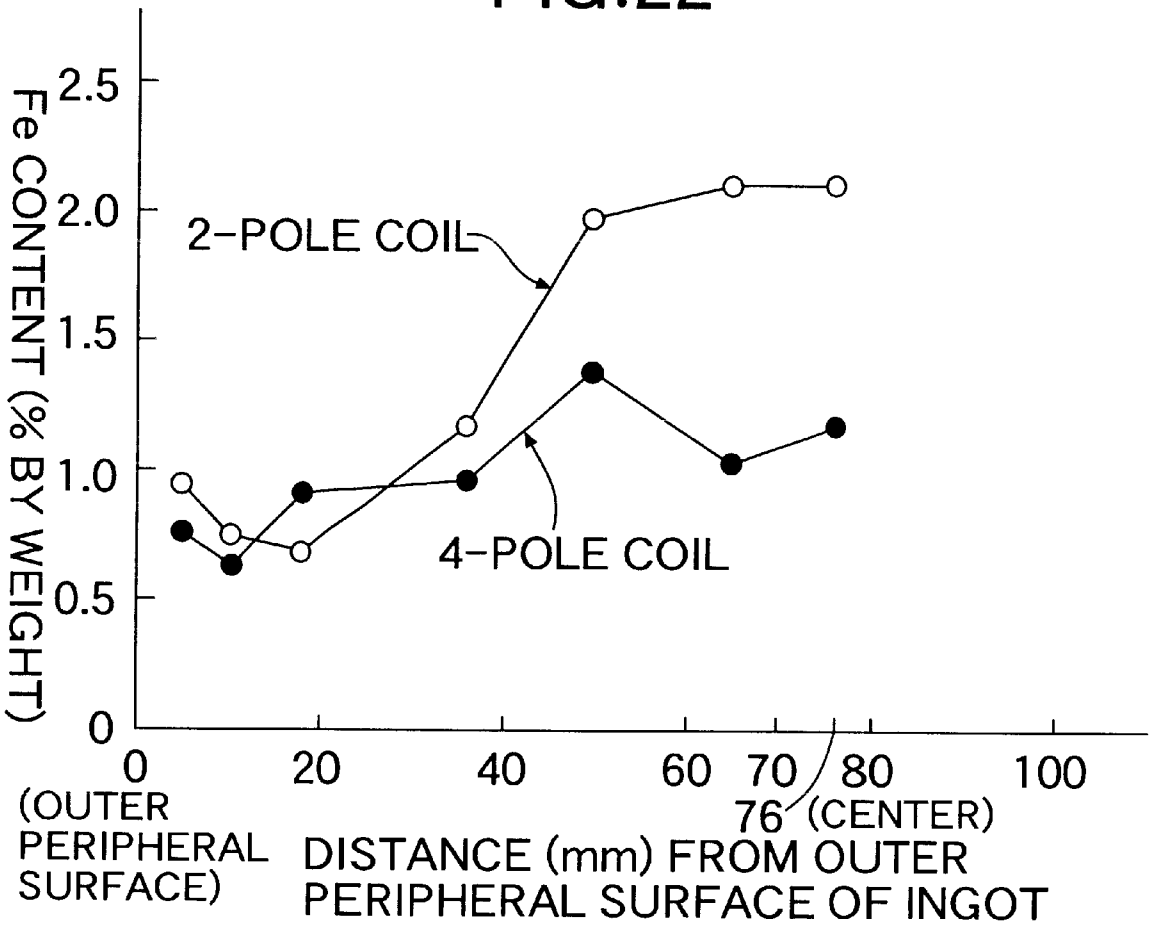
FIG. 22 is a graph showing the relationship between the distance from an outer peripheral surface of an ingot and the Fe content.
Figure 23A:
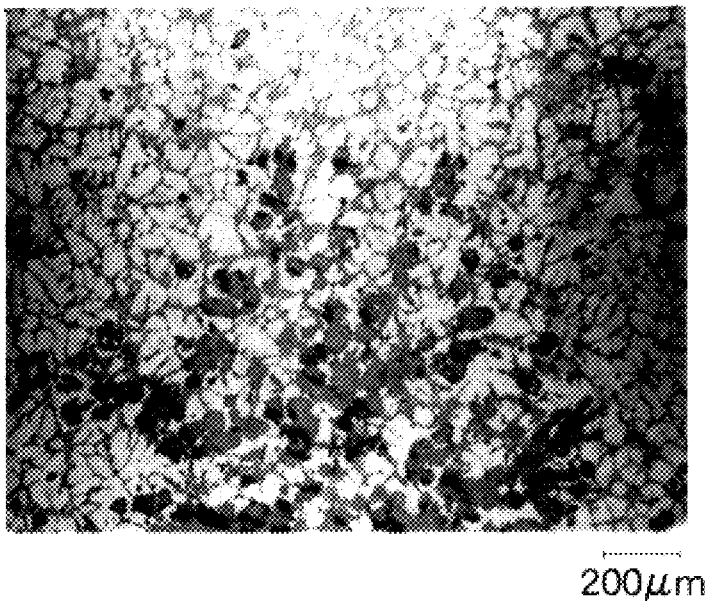
FIG. 23A is a microphotograph showing the metallographic structure of an ingot example (1)
Figure 23B:
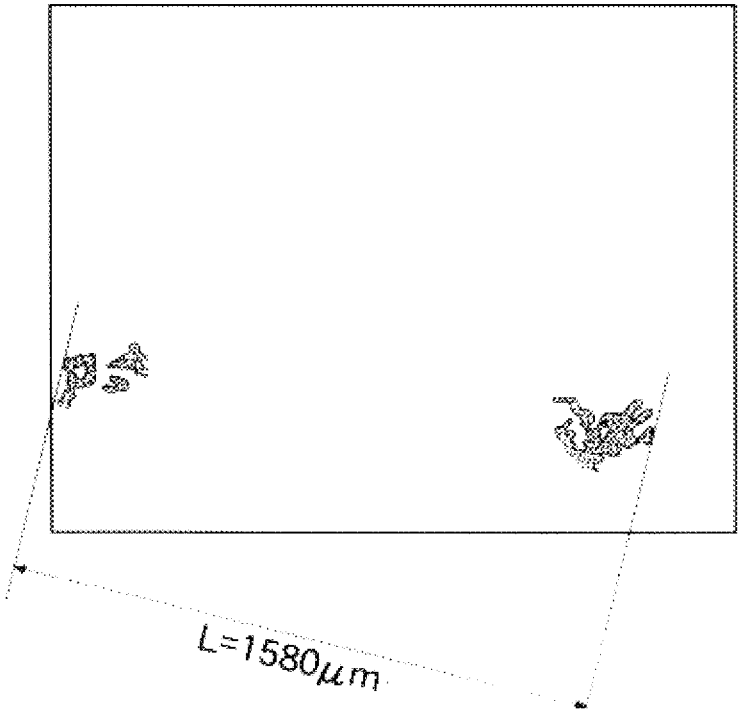
FIG. 23B is a tracing of an essential portion shown in FIG. 23A.
Figure 24A:
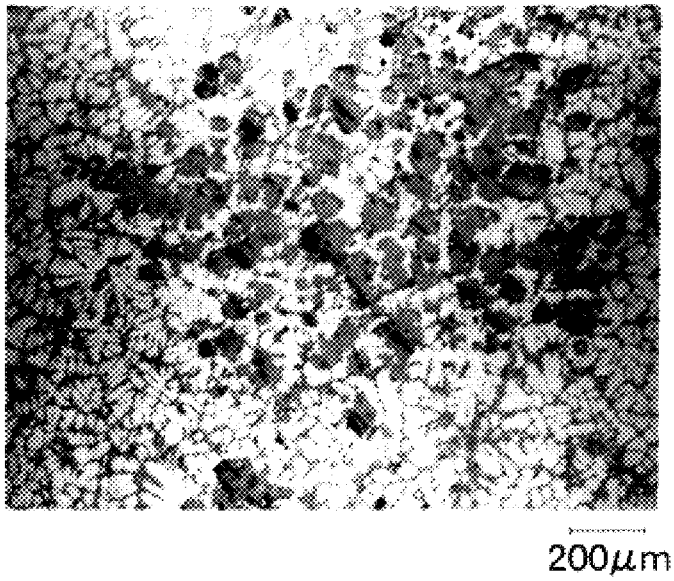
FIG. 24A is a microphotograph showing the metallographic structure of an ingot example (2)
Figure 24B:
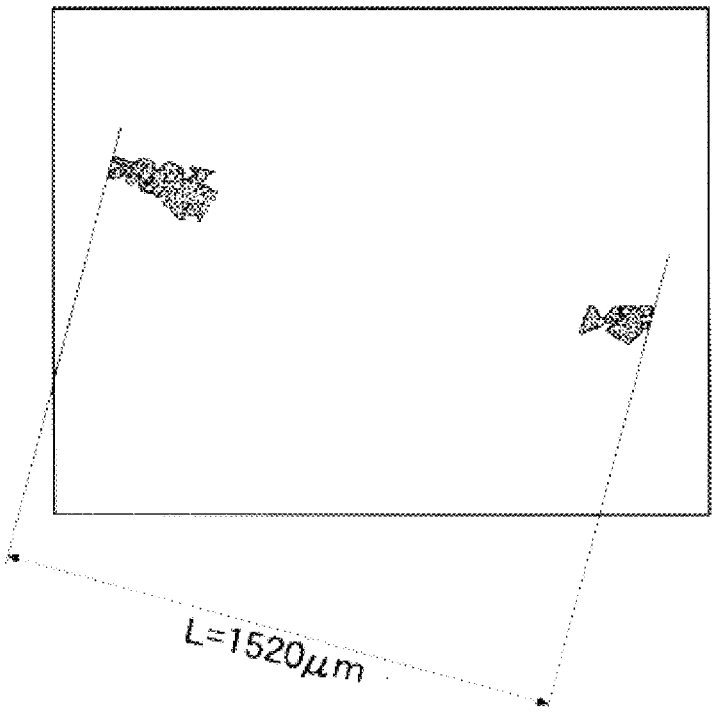
FIG. 24B is a tracing of an essential portion shown in FIG. 24A.
Figure 25A:
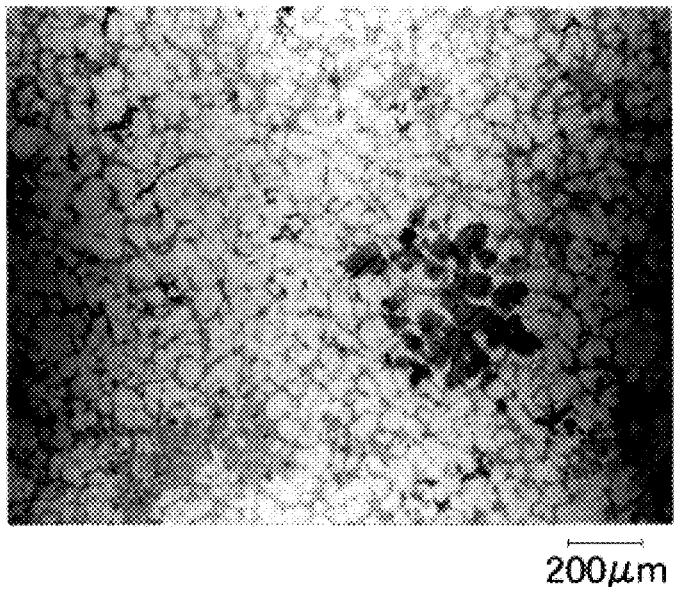
FIG. 25A is a microphotograph showing the metallographic structure of an ingot example (7)
Figure 25B:
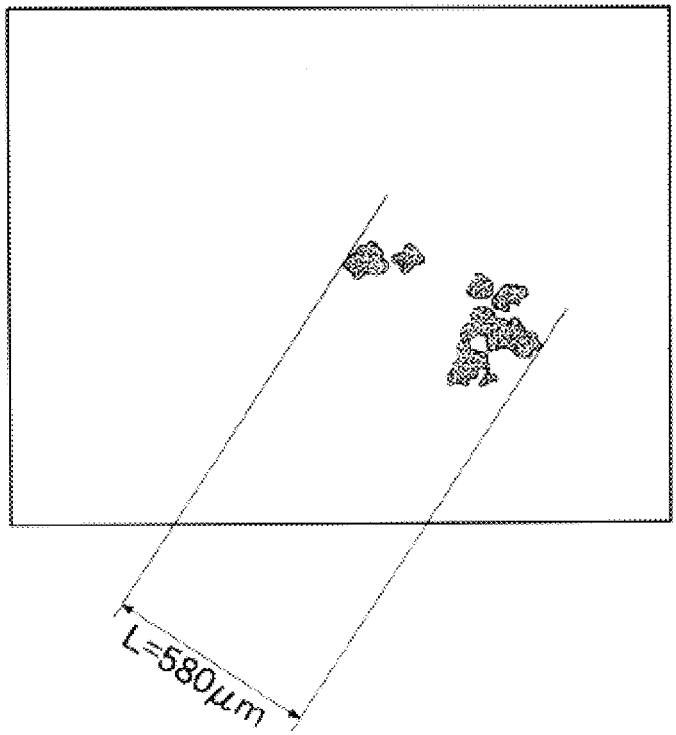
FIG. 25B is a tracing of an essential portion shown in FIG. 25A.

The relationship between that position on the radius which is spaced at a certain distance apart from the outer peripheral surface and the Fe content in such position was examined for both of the ingots I to provide results shown in FIG. 22. It can be seen from FIG. 22 that when the 4-pole coil is used, the distribution of Fe on the radius of the ingot is uniform, as compared with the case where the 2-pole coil is used. When the 2-pole coil was used, it is obvious that the segregation of intermetallic compounds including Fe was produced in the center zone.

Using example (1) of the aluminum alloy, examples (1) to (11) of ingots I were produced in a casting manner in the agitated continuous casting apparatus 1 including the 4-pole coils under the same conditions as those described above, except that the magnetic flux density B in the molten metal agitating area forming portion e was varied by changing the electric current supplied to each of the coils 25. For comparison, the same casting operation as those described above was carried out using an agitated continuous casting apparatus having 2-pole coils to produce example (12) of an ingot I. The length L of the longest portion of an agglomerate (Fe-based intermetallic compound) in an outer peripheral zone of each of examples (1) to (12) of the ingots I was measured, and the presence or absence of the segregation in the center zone was examined, thereby providing results given in Table 12.

TABLE 12

| Example of ingot | Magnetic flux density: B in molten metal agitating area forming portion (Gs) | Magnetic flux density: $B_1$ in center zone (Gs) | Length L of longest portion of agglomerate (μm) | Presence or absence of segregation in center zone |
|---|---|---|---|---|
| (1) | 90 | 0 | 1580 | absence |
| (2) | 95 | 0 | 1520 | absence |
| (3) | 100 | 0 | 590 | absence |
| (4) | 100 | 0 | 580 | absence |
| (5) | 100 | 0 | 550 | absence |
| (6) | 300 | 0 | 590 | absence |
| (7) | 300 | 0 | 580 | absence |
| (8) | 320 | 0 | 580 | absence |
| (9) | 360 | 0 | 550 | absence |
| (10) | 490 | 0 | 540 | absence |
| (11) | 490 | 0 | 500 | absence |
| cast example 1 | 500 | 0 | break-out | |
| cast example 2 | 500 | 0 | break-out | |
| (12) | 490 | 360 | 550 | presence |

The cast examples 1 and 2 in Table 12 were produced in a casting manner by the agitated continuous casting apparatus 1 having the 4-pole coils with the magnetic flux density in the molten metal agitating area forming portion e being set at B=500 Gs. In the cases of these cast examples 1 and 2, a break-out was generated to make the casting impossible.

FIGS. 23A and 23B, 24A and 24B, and 25A and 25B show the metallographic structures of examples (1), (2) and (7) of the ingots I and the lengths L of the longest portions of the agglomerates, respectively.

Then, using casting materials obtained from a plurality of ingots made from example (1) of an aluminum alloy and having agglomerates of different sizes, a thixocasting process was carried out to produce aluminum alloy members. Casting conditions are as follows: The temperature of the casting material was set at 565° C.; the injection speed was set at 2.0 m/sec; and the temperature of a mold was set at 250° C.

Figure 26:
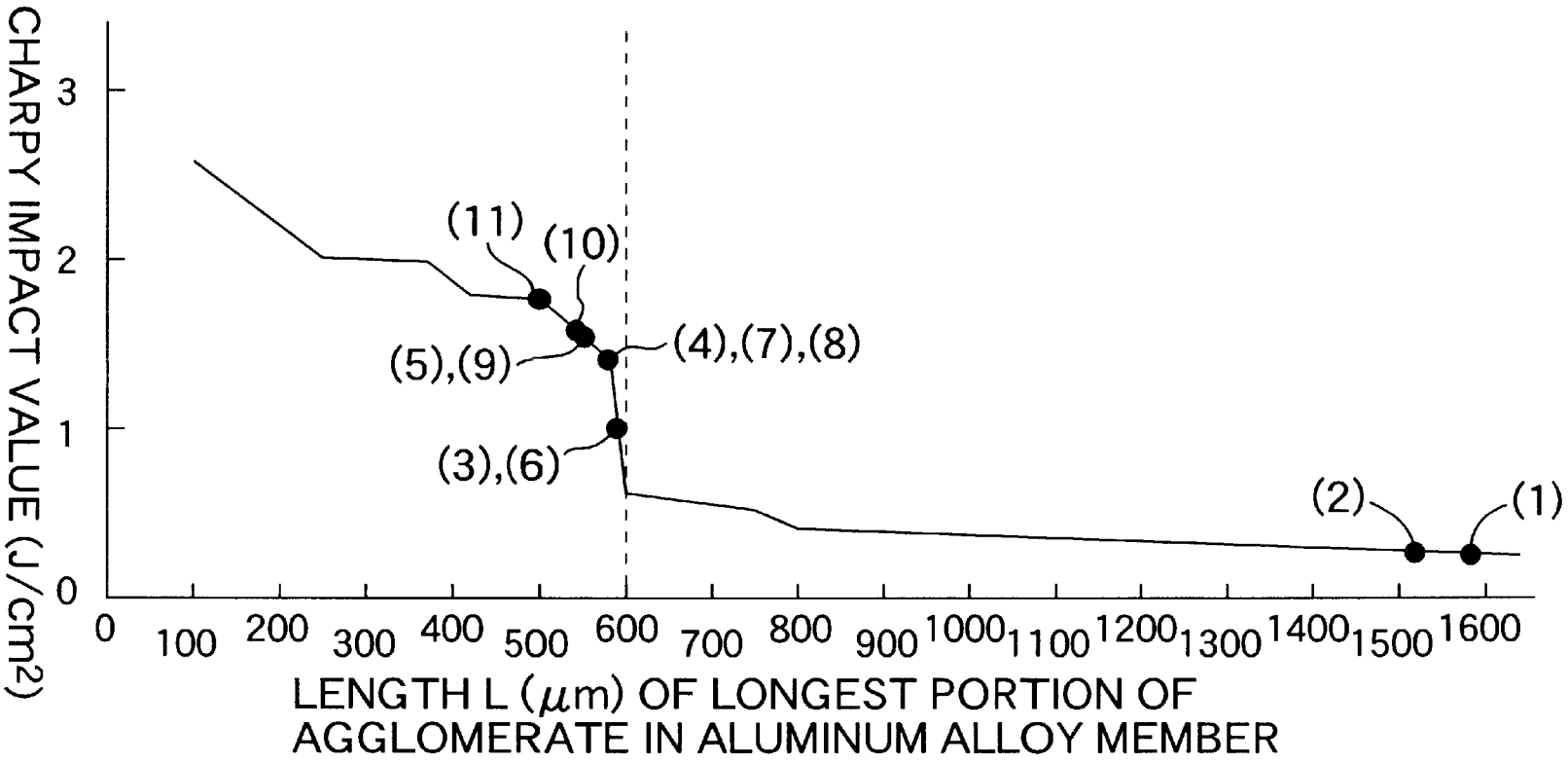
FIG. 26 is a graph showing the relationship between the length L of the longest portion of an agglomerate in an aluminum alloy member and the Charpy impact value.

FIG. 26 shows the relationship between the length L of the longest portion of the agglomerate in each of the aluminum alloy members and the Charpy impact valve (notched). In FIG. 26, points (1) to (11) correspond to the aluminum alloy members produced from examples (1) to (11) of the ingots I given in Table 12 used as casting materials.

It can be seen from FIG. 26 that if the length L of the longest portion of the agglomerate is equal to or larger than 600 $\mu$m, the Charpy impact value of the aluminum alloy member is decreased. Therefore, to ensure that the length L is smaller than 600 $\mu$m, it is necessary to set the magnetic flux density B in the molten metal agitating area forming portion e at B≦100 Gs, as shown in Table 12. In addition, to avoid the generation of the break-out, the magnetic flux density B should be set at B<500 Gs.

The magnetic flux density B in the molten metal agitating area forming portion e can be varied by increasing or decreasing the protrusion amount Δr of the spout 15.

EXAMPLE 2

Table 13 shows the compositions of aluminum alloy examples (2) to (12).

TABLE 13

| Aluminum alloy | Chemical constituent (% by weight) | | | | | | | | | | |
|---|---|---|---|---|---|---|---|---|---|---|---|
| example | Cu | Si | Mg | Zn | Fe | Mn | Cr | Ni | Ti | Sr | Balance |
| (2) | 4.4 | 7.3 | 0.18 | 0.5 | 0.75 | 0.15 | 0.18 | 0.05 | 0.12 | 0.02 | Al |
| (3) | 4.5 | 7 | 0.18 | 0.5 | 0.85 | 0.67 | 0.2 | 0.05 | 0.2 | 0.02 | Al |
| (4) | 4.4 | 7 | 0.18 | 0.5 | 1 | 0.98 | 0.21 | 0.06 | 0.1 | 0.02 | Al |
| (5) | 4.5 | 7.1 | 0.18 | 0.5 | 1.2 | 0.79 | 0.2 | 0.05 | 0.2 | 0.02 | Al |
| (6) | 4.4 | 7.1 | 0.18 | 0.5 | 1.5 | 0.3 | 0.2 | 0.07 | 0.1 | 0.02 | Al |
| (7) | 4.4 | 7.2 | 0.18 | 0.5 | 1.6 | 0.35 | 0.18 | 0.05 | 0.12 | 0.02 | Al |
| (8) | 4.5 | 7.2 | 0.18 | 0.5 | 0.7 | 0.15 | 0.19 | 0.05 | 0.15 | 0.02 | Al |
| (9) | 4.4 | 7 | 0.18 | 0.5 | 0.7 | 1.2 | 0.2 | 0.05 | 0.15 | 0.02 | Al |
| (10) | 4.4 | 7 | 0.18 | 0.5 | 0.75 | 0.1 | 0.2 | 0.05 | 0.15 | 0.02 | Al |
| (11) | 4.2 | 7 | 0.18 | 0.5 | 1 | 0.18 | 0.2 | 0.07 | 0.1 | 0.02 | Al |
| (12) | 4.4 | 7 | 0.18 | 0.5 | 1.5 | 0.25 | 0.21 | 0.06 | 0.1 | 0.02 | Al |

In these examples (2) to (12), the Mn and Fe contents in examples (2) to (7) are put in the triangular region as shown by the points (2) to (7) in FIG. 18, and the Mn and Fe contents in examples (8) to (12) are out of the triangular region as shown by the points (8) to (12) in FIG. 18.

Using the aluminum alloy examples (2) to (12), examples (2a) to (12a) of ingots I were produced in a casting manner by the agitated continuous casting apparatus 1. Examples (2a) to (12a) correspond to the aluminum alloy examples (2) to (12), respectively. Casting conditions are as follows: The melting temperature was set at 730° C.; the temperature of the molten metal immediately above the spout 15 was set at 650° C.; the cast product withdrawing speed was set 150 mm/min; the protrusion amount Δr of the spout 15 was set at 2 mm; the diameter of the ingot I was 152.4 mm; the magnetic flux density in the molten metal agitating area forming portion e was set at 300 Gs (4-pole coils and 50 Hz); and the average cooling speed of the molten metal Mm in the molten metal agitating area forming portion e was set at 10° C./sec.

The presence or absence of an agglomerate in the outer peripheral zone was microscopically examined for each of examples (2a) to (12a) of the ingots I. When the agglomerate was present, the length L of the longest portion of the agglomerate was measured.

For comparison, using the aluminum alloy examples (2) to (12), examples (2b) to (12b) of ingots I were produced in a casting manner under the same conditions as those described above by the agitated continuous casting apparatus having the 2-pole coils. The examples (2b) to (12b) correspond to the aluminum alloy examples (2) to (12), respectively.

The presence or absence of an agglomerate in the outer peripheral zone was microscopically examined for each of examples (2b) to (12b) of the ingots I. When the agglomerate was present, the length L of the longest portion of the agglomerate was measured.

Table 14 shows results of the microscopic examination and the measurement.

TABLE 14

| | Agglomerate | |
|---|---|---|
| Example of ingot | Presence or absence | Length L ($\mu$m) of longest portion |
| (2a) | presence | 550 |
| (2b) | | 750 |

TABLE 14-continued

| Example of ingot | Agglomerate | |
|---|---|---|
| | Presence or absence | Length L (μm) of longest portion |
| (3a) | presence | 500 |
| (3b) | | 690 |
| (4a) | presence | 550 |
| (4b) | | 790 |
| (5a) | presence | 500 |
| (5b) | | 810 |
| (6a) | presence | 390 |
| (6b) | | 750 |
| (7a) | presence | 540 |
| (7b) | | 800 |
| (8a) | absence | — |
| (8b) | | — |
| (9a) | absence | — |
| (9b) | | — |
| (10a) | absence | — |
| (10b) | | — |
| (11a) | absence | — |
| (11b) | | — |
| (12a) | absence | — |
| (12b) | | — |

As apparent from Table 14, because the agglomerate appeared in examples (2a), (2b) to (7a), (7b) of the ingots, the aluminum alloy examples (2) to (7) and thus, the aluminum alloys having the composition put in the triangular region shown in FIG. 18 are intended for the present invention. It can be seen from Table 14 that if the 4-pole coil is used, the length L of the longest portion of the agglomerate can be suppressed to a value smaller than 600 μm.

Figure 27A:
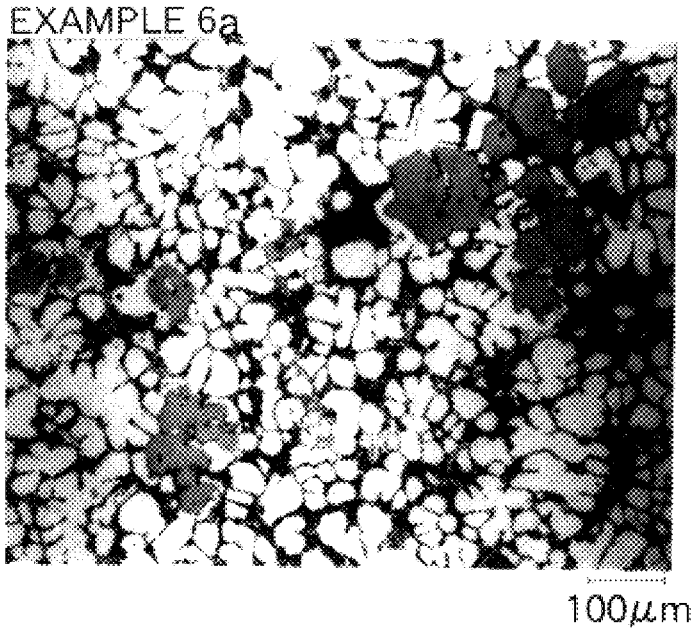
FIG. 27A is a microphotograph showing the metallographic structure of an ingot example (6a)
Figure 27B:
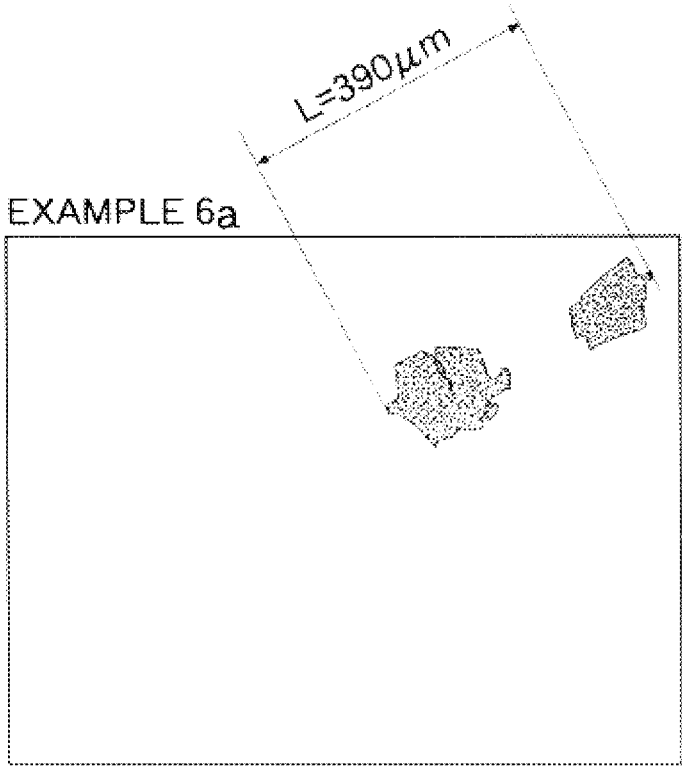
FIG. 27B is a tracing of an essential portion shown in FIG. 27A.
Figure 28A:
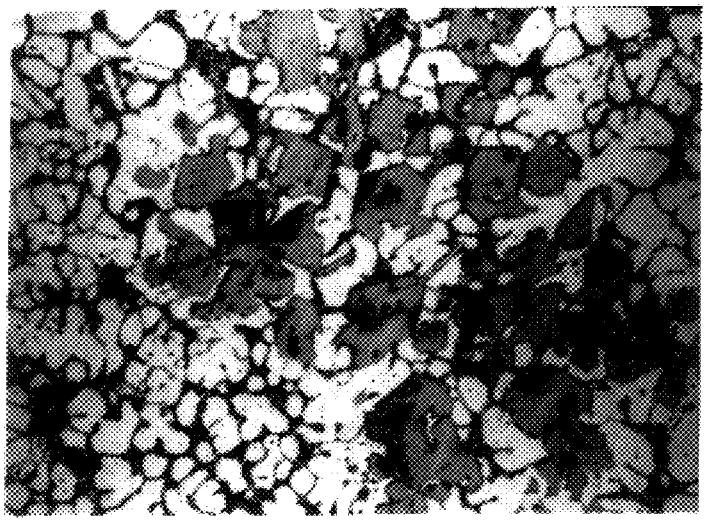
FIG. 28A is a microphotograph showing the metallographic structure of an ingot example (6b)
Figure 28B:
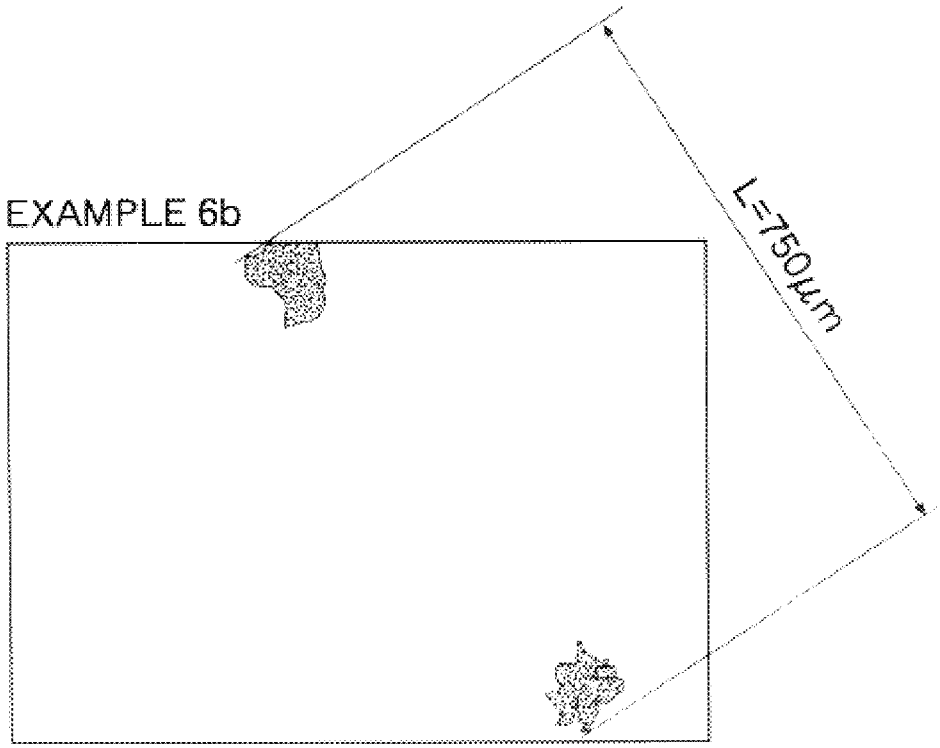
FIG. 28B is a tracing of an essential portion shown in FIG. 28A.

FIGS. 27A and 27B as well as FIGS. 28A and 28B show the metallographic structures and the lengths L of the longest portions of the agglomerates in examples (6a) and (6b) of the ingots I, respectively.

Figure 29:
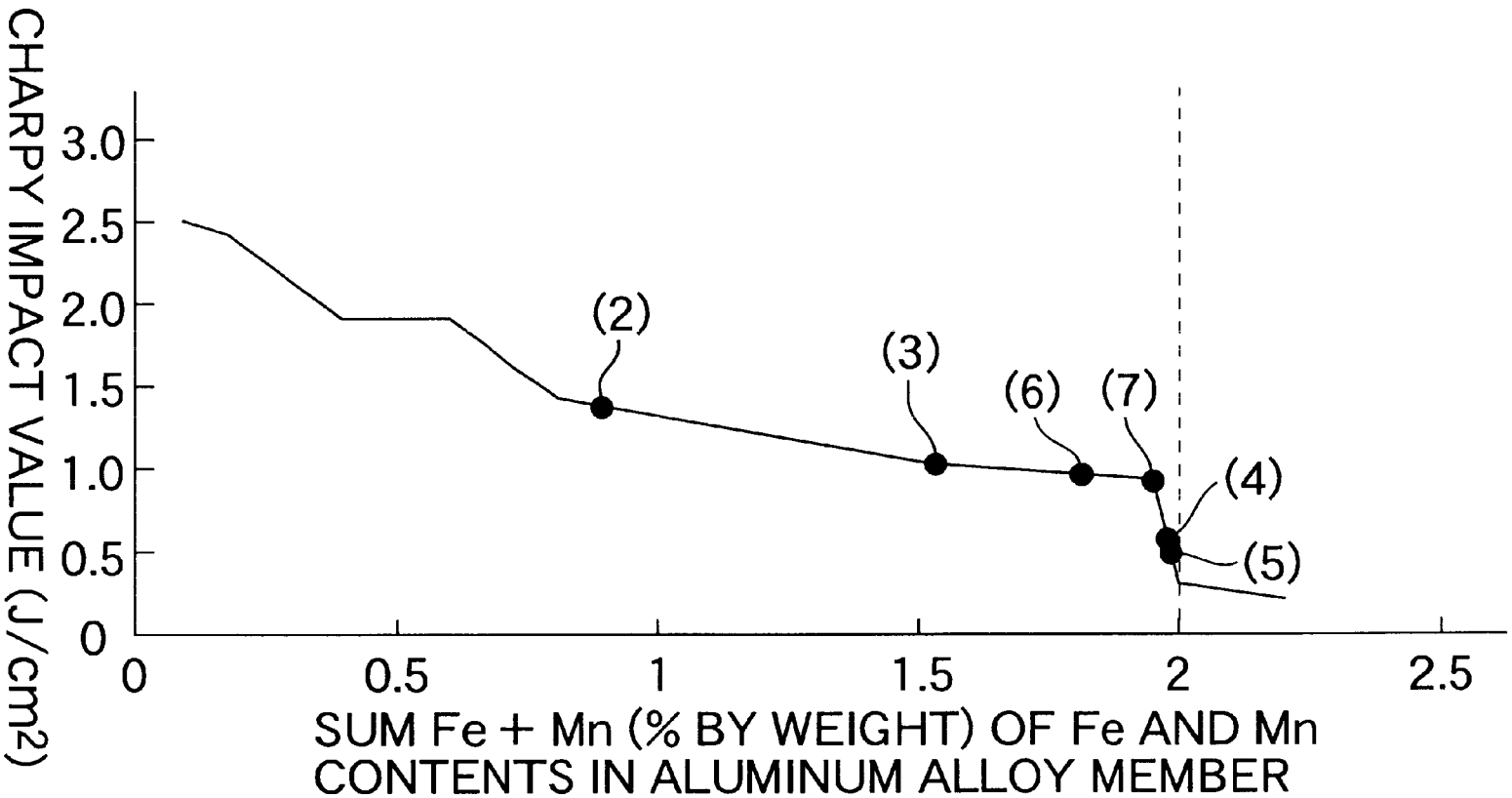
FIG. 29 is a microphotograph showing the relationship between the sum Fe+Mn of the Fe and Mn contents in each of aluminum alloy members and the Charpy impact value.

FIG. 29 shows the relationship between the sum Fe+Mn of the Fe and Mn contents and the Charpy impact value (notched) in each of aluminum alloy members made in a thixocasting process. In FIG. 29, the aluminum alloy members indicated by the points (2) to (7) correspond to those produced using casting materials made from the ingot examples (2a) to (7a) shown in Table 14.

It can be seen from FIG. 29 that if the sum Fe+Mn is equal to or higher than 2% by weight, the Charpy impact value of the aluminum alloy member is decreased. Therefore, the composition on the line Mn=−Fe+2 in FIG. 18 is not included in the composition of the aluminum alloy intended for the present invention.

What is claimed is:

1. An agitated continuous casting process for an aluminum alloy, comprising continuously casting a molten metal of an aluminum alloy composition while applying an electromagnetic agitating force to said molten metal, wherein said molten metal of the aluminum alloy composition used has an Fe content in a range of $0.75\% \leqq Fe \leqq 2\%$ by weight and an Si content in a range of $7.0\% \leqq Si \leqq 7.5\%$ by weight, and wherein an Mn content in said molten metal of the aluminum alloy composition is in a range of $a/2 < Mn < a$, and a Cr content in said molten metal is in a range of $a10 < Cr < a/4$, wherein a represents the Fe content.

2. An agitated continuous casting process for an aluminum alloy according to claim 1, wherein said continuous casting is carried out using a continuous casting apparatus which comprises a spout having an upward-turned molten metal receiving port and a downward-turned molten metal outlet, a cylindrical water-cooled casting mold disposed immediately below said spout to cool a molten metal from said molten metal outlet, and an agitator operable to apply the electromagnetic agitating force to said molten metal of the aluminum alloy composition within said spout, and wherein an average cooling speed MCR of said molten metal contacting a molten metal agitating area forming portion of an inner peripheral surface of the spout is set in a range of $0.5\ C/sec \leqq MCR \leqq 20°\ C./sec$, and a magnetic flux density B in said molten metal agitating area forming portion is set in a range of $100\ Gs \leqq B < 500\ Gs$.

3. An agitated continuous casting process for an aluminum alloy according to claim 2, wherein said molten metal agitating area forming portion of the inner peripheral surface of the spout assumes a tapered shape with its inside diameter thereof gradually increased from an upper peripheral edge thereof toward said molten metal outlet.

4. An agitated continuous casting process for an aluminum alloy, comprising introducing a molten metal of an aluminum alloy composition into a cylindrical water-cooled casting mold disposed immediately below a spout, while agitating said molten metal within said spout, wherein said molten metal of the aluminum alloy composition used has an Fe content in a range of $0.75\% \leqq Fe < 2\%$ by weight, and an Mn content of said molten metal is set at $Mn \leqq \{(Fe/5)+0.2\}\%$ by weight, when the Fe content is in a range of $0.75\% \leqq Fe \leqq 1.5\%$ by weight, while being $Mn \leqq \{-Fe+2\}\%$ by weight, when the Fe content is in a range of $1.5\% < Fe < 2\%$ by weight; and a cooling speed CR of said molten metal in an upper peripheral edge of a molten metal agitating area forming portion on an inner peripheral surface of said spout is set in a range of $10°\ C./sec \leqq CR \leqq 30°\ C./sec$.

5. An agitated continuous casting process for an aluminum alloy, comprising introducing a molten metal of an aluminum alloy composition into a cylindrical water-cooled casting mold disposed immediately below a spout, while agitating said molten metal with said spout, wherein said molten metal of the aluminum alloy composition used has an Fe content in a range of $\{3/4\}\% \leqq Fe < \{5/3\}\%$ by weight, an Mn content in a range of $\{Fe/5\}\% \leqq Mn < \{-Fe+2\}\%$ by weight; a magnetic flux density $B_1$ in a molten metal agitating area forming portion on an inner peripheral surface of said spout is set in a range of $100\ Gs \leqq B_1 < 500\ Gs$; and a magnetic flux density $B_2$ in a center zone of a molten metal agitating area is set at $B_2 \leqq 20\ Gs$.

6. An agitated continuous casting process for an aluminum alloy according to claim 5, wherein an electromagnetic induction-type agitator for electromagnetically agitating said molten metal includes multi-pole coils having 4 or more poles.

* * * * *